US011186301B1

(12) United States Patent
Braren et al.

(10) Patent No.: US 11,186,301 B1
(45) Date of Patent: Nov. 30, 2021

(54) SYSTEM AND METHOD FOR WHEEL IMPACT LOAD DETECTION COMPENSATION

(71) Applicant: BNSF Railway Company, Fort Worth, TX (US)

(72) Inventors: Hark Braren, Fort Worth, TX (US); Bryan Frank, Fort Worth, TX (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

(21) Appl. No.: 17/304,063

(22) Filed: Jun. 14, 2021

(51) Int. Cl.
*B61L 23/04* (2006.01)
*B61L 27/00* (2006.01)
*B61L 25/02* (2006.01)

(52) U.S. Cl.
CPC ..... *B61L 23/045* (2013.01); *B61L 25/025* (2013.01); *B61L 27/0094* (2013.01); *B61L 2205/04* (2013.01)

(58) Field of Classification Search
CPC .. B61L 23/045; B61L 25/025; B61L 27/0094; B61L 2205/04
See application file for complete search history.

(56) References Cited

U.S. PATENT DOCUMENTS 7,693,673 B2 * 4/2010 Luo ..... G01K 15/00 702/99
8,305,567 B2 * 11/2012 Hesser ..... E01B 35/00 356/237.1
9,365,223 B2 * 6/2016 Martin ..... B61L 15/0027
9,393,975 B2 * 7/2016 Chen ..... B61L 15/0081
9,689,760 B2 * 6/2017 Lanza di Scalea . G01M 5/0066
9,751,541 B2 * 9/2017 Betancur Giraldo . G01M 17/10
9,876,856 B2 * 1/2018 Dorn ..... H04L 67/12
9,981,671 B2 5/2018 Fraser et al.
10,137,915 B2 * 11/2018 LeFebvre ..... B61L 15/0081
10,259,477 B2 * 4/2019 LeFebvre ..... B61L 25/025
(Continued)

FOREIGN PATENT DOCUMENTS

EP 1600351 B1 1/2007
WO 2019174834 A1 9/2019

OTHER PUBLICATIONS

Alemi, Alireza; Corman, Francesco; Lodewijks, Gabri; Condition monitoring approaches for the detection at railway wheel defects; 2017; p. 1-27.

(Continued)

*Primary Examiner* — Jason C Smith
(74) *Attorney, Agent, or Firm* — Enrique Sanchez; Whitaker Chalk Swindle & Schwartz PLLC

(57) ABSTRACT

A wheel impact load detection system for detecting defects in wheel of railroad vehicles is presented. The system can receive data from sensors and/or a weather station to determine a maximum force applied to a rail, and subsequently calibrate the determined maximum force to account to environmental conditions. Additionally, the present disclosure can assign severity levels and generate alerts with the assigned severity levels, and such severity levels can facilitate the proper prioritization of the alerts. It is an object of the invention to provide a system for accounting for variable environmental conditions and/or variable rail tension in assigning severity levels to mitigate unneeded stoppage of railway traffic.

20 Claims, 8 Drawing Sheets

(56) References Cited

U.S. PATENT DOCUMENTS

| | | | | |
|---|---|---|---|---|
| 10,752,271 | B2 | 8/2020 | Chung et al. | |
| 11,136,053 | B2 * | 10/2021 | Plotnikov et al. | B61L 23/044 |
| 2019/0225248 | A1 * | 7/2019 | Lidgett | B61D 7/02 |
| 2019/0319835 | A1 * | 10/2019 | Mansfield | H04L 67/12 |
| 2020/0023870 | A1 * | 1/2020 | Mansfield | H01Q 3/2605 |
| 2020/0079343 | A1 * | 3/2020 | Martin | B60T 17/221 |
| 2021/0291883 | A1 * | 9/2021 | Gotlund | B61L 27/0077 |

OTHER PUBLICATIONS

Stasys Steišūnas et. al; Estimation of ambient temperature impact on vertical dynamic behaviour of passenger rail vehicle with damaged wheels; Jul. 17, 2018; p. 5179-5188.

* cited by examiner

SYSTEM AND METHOD FOR WHEEL IMPACT LOAD DETECTION COMPENSATION

TECHNICAL FIELD

The present disclosure relates generally to wheel impact load detection in a railroad infrastructure.

BACKGROUND

In current railroad infrastructure, wheel impact load detection systems are commonly installed to notify railroad personnel of potential defects in wheels of vehicles that travel on railroad tracks. Generally speaking, wheel impact load detection systems include strain gauges coupled to the rails that are operable to measure the strain or stress applied to the rail. As a train or other vehicle travels over the portion of the rail to which the strain gauges are attached, the strain gauges can measure the increase in strain caused by the vehicle. This increase in strain can correlate to a measurement of force exerted by the vehicle's wheel(s) on the rail. Strain gauges are often spread over a sufficient length of rail to allow for the gathering of force measurements corresponding to the entire circumference of a given wheel, as opposed to just a particular section.

Railroad vehicles are carefully loaded to ensure that the total weight of the vehicle and cargo combined does not exceed weight limits of track and vehicle infrastructure, and if there are no defects in vehicle wheels or the rails on which they travel, strain gauge measurements will generally reflect that trains traveling on the rails are exerting tolerable forces on the rails. However, if a wheel has a defect (e.g., a flat caused by sliding or mechanical shelling, etc.), this can cause increased force to be applied by the vehicle to the track via the defective wheel. These forces can be measured by strain gauges and ultimately detected by the overarching wheel impact load detection system, which can then alert railroad personnel to the potential defects.

Because of the need to keep trains moving to satisfy schedules and delivery timelines, railroad systems will often prioritize alerts that correspond to many potential issues, including detected wheel impact loads indicating wheel defects. Some alerts can indicate a serious problem and require a vehicle to be immediately stopped and inspected; some alerts can indicate that an inspection can wait until the train is next serviced. With respect to wheel impact load detection, such prioritization is generally dependent on the amount of force detected by the strain gauges—the higher the force, the more serious the alert, and the higher priority it is given. As an example of this prioritization, the American Association of Railroads (AAR) promulgates different levels of concern corresponding to different detected force values in wheel impact load detection, which are often measured in "kips," or thousands of pounds. The AAR considers a wheel to be "condemnable" (i.e., can be condemned by the railroad) if a wheel's kip value is greater than 90. In addition to guidelines from the AAR, railroads will often maintain their own internal priority systems for condemnable wheels to assist them in managing the sheer volume of alerts that may be generated on any given day. However, the time constraints inherent in railroad operation mean that incorrect prioritization can be devastating to efficiency and productivity of railroad operation. Therefore, ensuring proper prioritization of alerts is key for successful and reliable implementation of a wheel impact load detection system.

SUMMARY

The present disclosure achieves technical advantages as a system and method for wheel impact load detection (WILD) that can prioritize alerts by accounting for environmental conditions. The system can account for the variability in rail tension caused by environmental conditions (e.g., temperature, pressure, humidity, etc.) when assigning severity levels to alerts. The system can receive data that can be indicative of force exerted by a vehicle on a track, calibrate the received data to account for the environmental conditions, utilize the calibrated data in assigning a severity level that dictates prioritization in a railroad system, and then generate an alert with the assigned severity level.

The present disclosure solves the technological problem of providing a wheel impact load detection system configured to account for environmental conditions in prioritizing generated alerts. The present disclosure can calculate values from received data, calibrating relevant values using received data, deciding when to use original data or calibrated data, and comparing original or calibrated values (as appropriate) to predetermined thresholds to facilitate proper prioritization. Such specialized processing can also provide the benefit of increasing railroad system operational efficiency by mitigating incorrectly prioritized alerts that can be caused by, for example, increased rail tension due to linear shrinkage of rails in cold weather.

The present disclosure improves the performance and functionality of the system itself by implementing specialized algorithms adapted to data related to environmental conditions proximate a sensor (e.g., strain gauge, load cell, accelerometer, etc.). The system can assign severity levels related to received WILD sensor data in light of environmental conditions related to received environmental data. In contrast, traditional systems simply rely on often-incomplete data and assume uniform conditions without adjusting values based upon feedback values to account for, e.g., variable rail tension and/or linear shrinkage/expansion, resulting in improperly prioritized alerts that can diminish operational efficiency and often lead to the disastrous stoppage of generally healthy railroad vehicles. In certain embodiments, the disclosed WILD system not only determines when data needs to be calibrated but can also determine if the calibration should change the severity level of the alert.

The disclosed WILD system can include a server in operable communication with a database, clients, and a weather station. The WILD system can further be in operable connection with a plurality of sensors or gauges designed to measure a force or forces exerted by a vehicle on a track. The WILD system can generate records containing relevant data, including vehicle identity, time and date of detection, the direction the vehicle is travelling when detected, the determined weight of the vehicle, the determined maximum force applied by the vehicle to the track, the proportion of the maximum force that can be attributed to a wheel defect, and the environmental conditions at the time of detection.

It is an object of the disclosure to provide a system for wheel impact load detection and alert generation. It is a further object of the disclosure to provide a method for generating prioritized alerts related to wheel impact load detection. These and other objects are provided by at least the following embodiments.

In one embodiment, a system for generating railroad alerts related to wheel impact load detection sensor data can include: a memory having a first database with a plurality of sensor data, thresholds, and specifications related to a vehicle and at least a portion of a track; and a networked computer processor operably coupled to the memory and capable of executing machine-readable instructions to perform program steps, the program steps including:

detecting the vehicle on the track; receiving environmental data; receiving sensor data corresponding to a force or forces exerted by the vehicle on the track; determining an original max peak force from the sensor data; comparing the original max peak force with a first force threshold; if the original max peak force exceeds the first force threshold: determining if the environmental data satisfies an environmental threshold; and if the environmental data satisfies the environmental threshold, generating, via the processor, a calibrated max peak force; utilizing either the original max peak force or the calibrated max peak force in assigning a severity level; generating an alert including the severity level; and if the original max peak force is below the first force threshold, no alert is generated. Wherein the calibrated max peak force is generated by normalizing the original max peak force using an operational variable. Wherein the program steps can further include: generating a plot of the sensor data; comparing a plurality of points on the plot that correspond with the sensor data; recognizing a static peak force trend in the plot; determining a weight value using the static peak force trend; and calculating a dynamic force value using the original max peak force and the weight value. Wherein the program steps further include determining a confidence level of the sensor data accuracy. Wherein the program steps further include utilizing the confidence level in assigning the severity level. Wherein the severity level can vary based on a magnitude of the original max peak force or the calibrated max peak force, and the confidence level. Wherein if the original max peak force exceeds the first force threshold and the calibrated max peak force is below the first force threshold, the severity level indicates that the calibrated max peak force was utilized in assigning the severity level. Wherein the vehicle is a train. Wherein: if the environmental data does not satisfy the environmental threshold, the original max peak force is utilized in assigning the severity level; and if the environmental data satisfies the environmental threshold, the calibrated max peak force is utilized in assigning the severity level. Wherein the environmental data includes weather data.

In another embodiment, a method of compensating for environmental conditions in wheel impact load detection can include the steps of: detecting a vehicle on a track; generating, via one or more processors, at least one record including a date, a time, a direction of the vehicle, and an Axle count of the vehicle; receiving environmental data; receiving sensor data from at least one strain gauge coupled to the track; determining an original max force value from the sensor data; comparing the original max force value with a first force threshold; if the environmental data satisfies an environmental threshold, generating, via the one or more processers, a calibrated max force value by calibrating the original max force value with an operational variable; if the original max force value exceeds the first force threshold, and if the calibrated max force value was not generated, utilizing the original max force value to assign a first severity level; if the original max force value exceeds the first force threshold, and if the calibrated max force value was generated, utilizing the calibrated max force value to assign a second severity level; generating an alert including either the first or second severity level; and updating the at least one record; wherein if the original max force value is below the first force threshold, the at least one record is updated without generating an alert. Wherein the environmental data includes temperature, and the environmental threshold is a temperature threshold. Further including the step of determining a confidence level in an accuracy of the sensor data. Wherein the confidence level is utilized with the original max force value to assign the first severity level. Wherein the confidence level is utilized with the calibrated max force value to assign the second severity level.

In another embodiment, a method of compensating for variable rail tension caused by environmental conditions in wheel impact load detection can include the steps of: detecting a vehicle on a track; receiving environmental data; receiving sensor data from at least one strain gauge coupled to the track; determining, via one or more processors, a max force value from the sensor data; if the max force value exceeds a first force threshold, determining if the environmental data satisfies an environmental threshold; if the max force value exceeds the first force threshold, and if the environmental data satisfies the environmental threshold, assigning a first severity level; and if the max force value exceeds the first force threshold, and if the environmental data does not satisfy the environmental threshold, assigning a second severity level; and generating an alert including the first or second severity level; wherein if the max force value is below the first force threshold, no alert is generated. Further including the step of utilizing a confidence level in assigning the first or second severity level. Wherein if the environmental threshold is satisfied, the confidence level is reduced. Wherein the environmental threshold is satisfied when a temperature is equal to or below 0° C. Further including the step of updating a record to indicate that the alert includes the first or second severity level.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The preferred version of the disclosure presented in the following written description and the various features and advantageous details thereof, are explained more fully with reference to the non-limiting examples included in the accompanying drawings and as detailed in the description, which follows. Descriptions of well-known components have been omitted so to not unnecessarily obscure the principal features described herein. The examples used in the following description are intended to facilitate an understanding of the ways in which the disclosure can be implemented and practiced. Accordingly, these examples should not be construed as limiting the scope of the claims.

Figure 1:
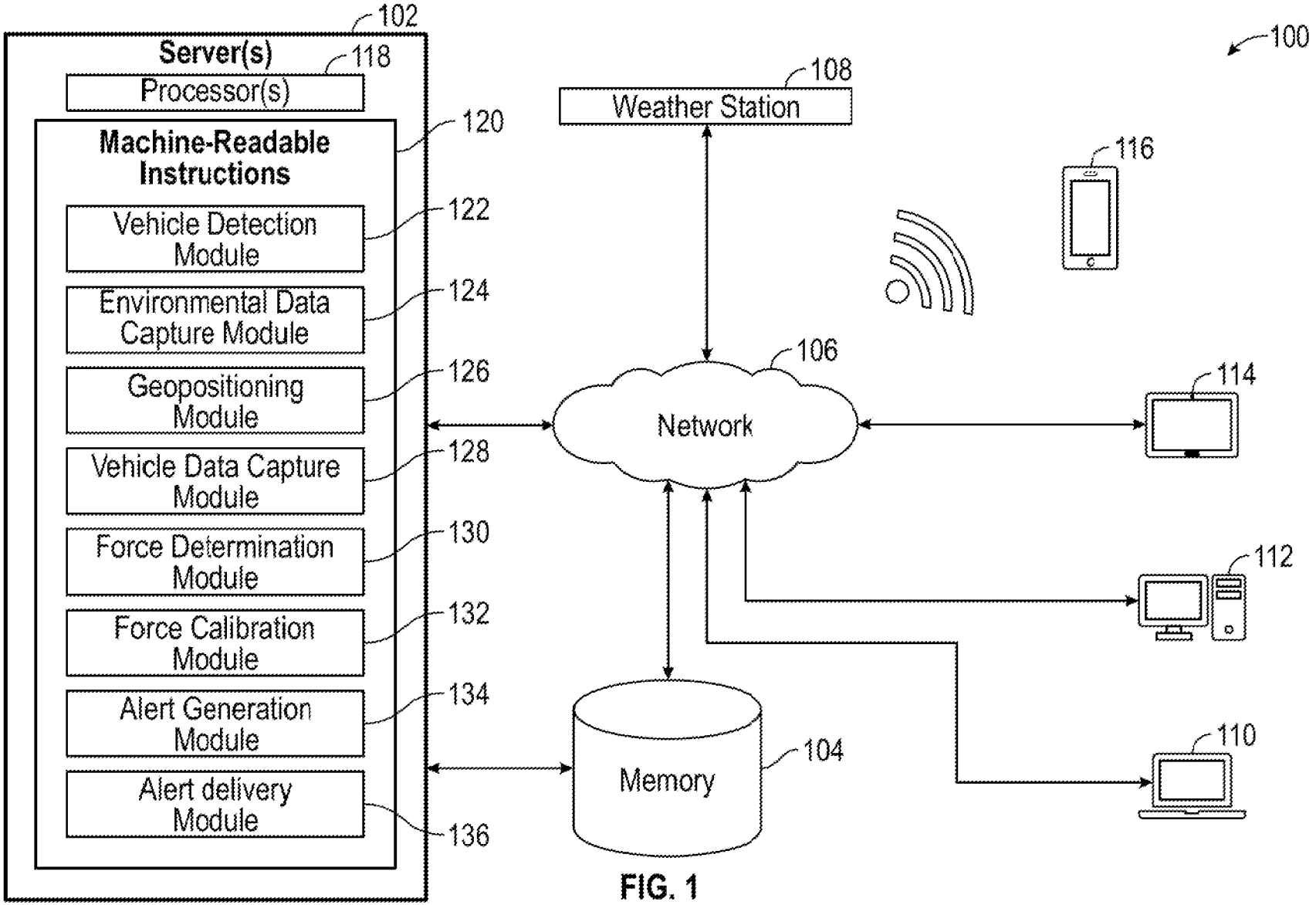
FIG. 1 illustrates an exemplary wheel impact load detection system schematic, in accordance with one or more exemplary embodiments of the present disclosure.

FIG. 1 illustrates a schematic view of a wheel impact load detection (WILD) system 100 in accordance with one or more embodiments of the present disclosure. The system 100 can include one or more servers 102 operably coupled to a database 104. The server 102 can be operably coupled to one or more clients 110, 112, 114, 116 via a network connection 106. The clients can be a physical device (e.g., mobile phone 116, computer 110, 112, tablet 114, wearable device, or other suitable device), program, or an application. In another embodiment, the server 102 can be operable coupled to weather station 108 via the network 106. For example, the weather station 108 can be a collection of weather-related sensors, such as thermometers, barometers, gauges, or any other suitable sensors for collection environmental data. In another example, the weather station 108 can be a networked computer 108 in operable connection with the server 102 that is capable of receiving and/or obtaining environmental data and transmitting the environmental data to the server 102. The WILD system 100 can be integrated with a railroad system or railroad infrastructure to facilitate the detection of defects in railroad components. It will be understood by those having skill in the art that detections, captured data, measurements, determinations, alerts, etc. encompassed by the WILD system 100 can be promulgated and/or accessible to a railroad system at large via the network 106 or other operable connection. In one embodiment, the server 102 can include machine-readable instructions 120; in another embodiment, the server 102 can access machine readable instructions 120. In another embodiment, the machine-readable instructions can include instructions related to a vehicle detection module 122, an environmental data capture module 124, a geopositioning module 126, a vehicle data capture module 128, a force determination module 130, a force calibration module 132, an alert generation module 134, and/or an alert delivery module 136.

The aforementioned system components (e.g., server(s) 102, weather station 108, and client(s) 110, 112, 114, 116, etc.) can be communicably coupled to each other via the network 140, such that data can be transmitted. The network 106 can be the Internet, intranet, or other suitable network. The data transmission can be encrypted, unencrypted, over a VPN tunnel, or other suitable communication means. The network 106 can be a WAN, LAN, PAN, or other suitable network type. The network communication between the clients, server 102, or any other system component can be encrypted using PGP, Blowfish, Twofish, AES, 3DES, HTTPS, or other suitable encryption. The system 100 can be configured to provide communication via the various systems, components, and modules disclosed herein via an application programming interface (API), PCI, PCI-Express, ANSI-X12, Ethernet, Wi-Fi, Bluetooth, or other suitable communication protocol or medium. Additionally, third party systems and databases can be operably coupled to the system components via the network 106.

The data transmitted to and from the components of system 100 (e.g., the server 102, weather station 108, and clients), can include any format, including JavaScript Object Notation (JSON), TCP/IP, XML, HTML, ASCII, SMS, CSV, representational state transfer (REST), or other suitable format. The data transmission can include a message, flag, header, header properties, metadata, and/or a body, or be encapsulated and packetized by any suitable format having same.

One or more server(s) 102 can be implemented in hardware, software, or a suitable combination of hardware and software therefor, and may comprise one or more software systems operating on one or more servers, having one or more processors 118, with access to memory 104. Server(s) 102 can include electronic storage, one or more processors, and/or other components. Server(s) 102 can include communication lines, connections, and/or ports to enable the exchange of information via a network 106 and/or other computing platforms. Server(s) 102 can also include a plurality of hardware, software, and/or firmware components operating together to provide the functionality attributed herein to server(s) 102. For example, server(s) 102 can be implemented by a cloud of computing platforms operating together as server(s) 102, including Software-as-a-Service (SaaS) and Platform-as-a-Service (PaaS) functionality. Additionally, the server(s) 102 can include memory 104 internally.

Memory 104 can comprise electronic storage that can include non-transitory storage media that electronically stores information. The electronic storage media of electronic storage can include one or both of system storage that can be provided integrally (e.g., substantially non-removable) with server(s) 102 and/or removable storage that can be removably connectable to server(s) 102 via, for example, a port (e.g., a USB port, a firewire port, etc.) or a drive (e.g., a disk drive, etc.). Electronic storage may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage may include one or more virtual storage resources (e.g., cloud storage, a virtual private network, and/or other virtual storage resources). The electronic storage can include a database, or public or private distributed ledger (e.g., blockchain). Electronic storage can store machine-readable instructions 120, software algorithms, control logic, data generated by processor(s), data received from server(s), data received from computing platform(s), and/or other data that can enable server(s) to function as described herein. The electronic storage can also include third-party databases accessible via the network 106.

Processor(s) 118 can be configured to provide data processing capabilities in server(s) 102. As such, processor(s) 118 can include one or more of a digital processor, an analog processor, a digital circuit designed to process information, an analog circuit designed to process information, a state machine, and/or other mechanisms for electronically processing information, such as FPGAs or ASICs. The processor(s) 118 can be a single entity or include a plurality of processing units. These processing units can be physically located within the same device, or processor(s) 118 can represent processing functionality of a plurality of devices or software functionality operating alone, or in concert.

The processor(s) 118 can be configured to execute machine-readable instructions 106 or machine learning modules via software, hardware, firmware, some combination of software, hardware, and/or firmware, and/or other mechanisms for configuring processing capabilities on processor(s) 118. As used herein, the term "machine-readable instructions" can refer to any component or set of components that perform the functionality attributed to the machine-readable instructions component 120. This can include one or more physical processors 118 during execution of processor-readable instructions, the processor-readable instructions, circuitry, hardware, storage media, or any other components.

The server(s) 102 can be configured with machine-readable instructions 120 having one or more functional modules. The machine-readable instructions 120 can be implemented on one or more servers 102, having one or more processors 118, with access to memory 104. The machine-readable instructions 120 can be a single networked node, or a machine cluster, which can include a distributed architecture of a plurality of networked nodes. The machine-readable instructions 120 can include control logic for implementing various functionality, as described in more detail below. The machine-readable instructions 120 can include certain functionality associated with the WILD system 100. Additionally, the machine-readable instructions 120 can include a smart contract or multi-signature contract that can process, read, and write data to a database, distributed ledger, or blockchain.

Figure 2:
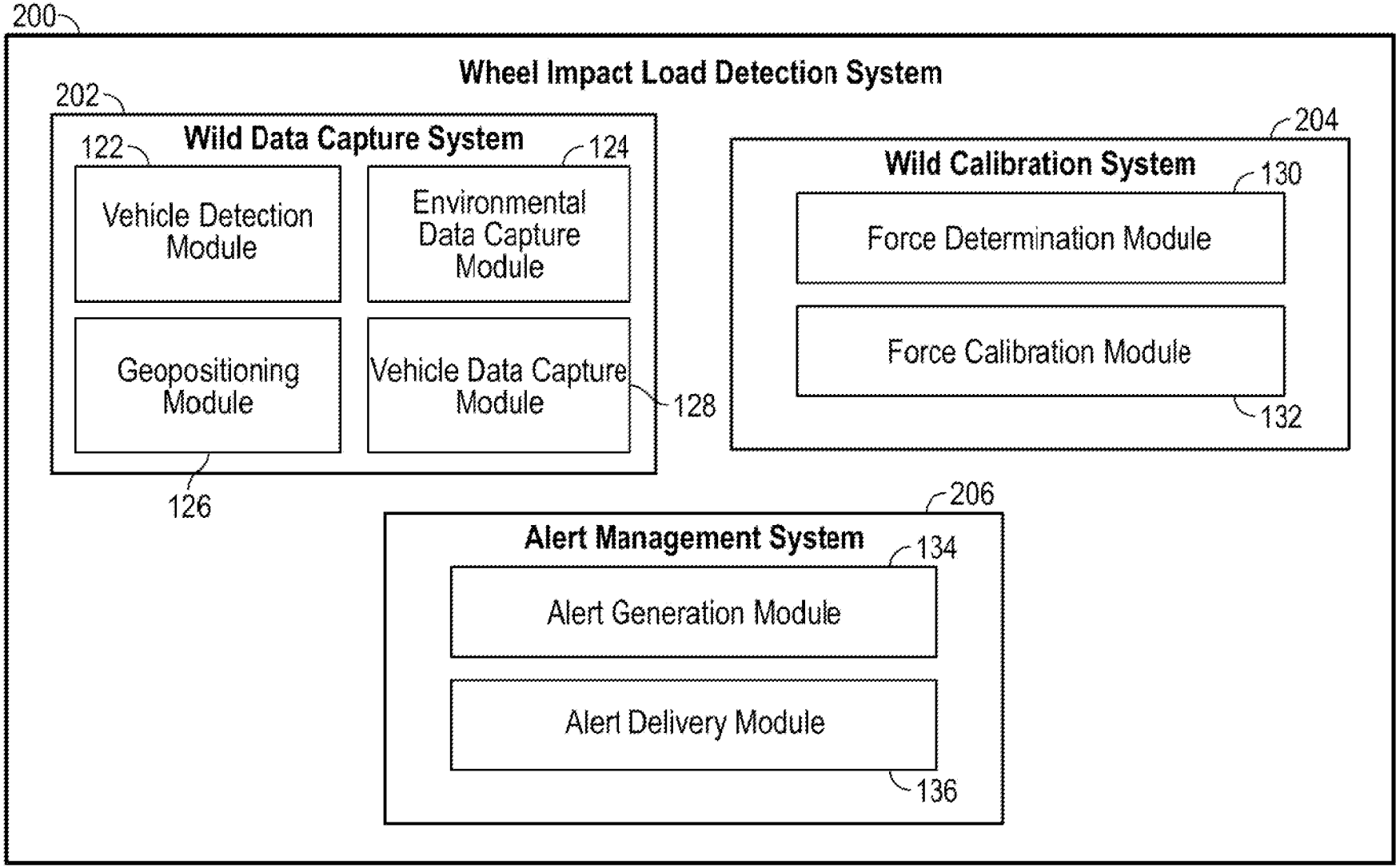
FIG. 2 illustrates an exemplary block diagram of a wheel impact load detection system, in accordance with one or more exemplary embodiments of the present disclosure.

FIG. 2 illustrates a schematic view of a wheel impact load detection system 200, in accordance with one or more exemplary embodiments of the present disclosure. WILD system 200 can include a WILD data capture system 202, a WILD calibration system 204, and an alert management system 206. In one exemplary embodiment, the WILD data capture system 202 can include a vehicle detection module 122, an environmental data capture module 124, a geopositioning module 126, and a vehicle data capture module 128. The vehicle detection module 122, environmental data capture module 124, geopositioning module 126, and vehicle data capture module 128 can implement one or more algorithms to facilitate data capture related to wheel impact load detection, including recognition, location-retrieving, and detection algorithms. In one embodiment, the WILD data capture system 202 can be configured to initiate upon detection of a vehicle on a track and subsequently capture a myriad of data related to the vehicle, the track, and the environment.

In one embodiment, the vehicle detection module 122 can detect a vehicle (e.g., a train or other rail-traveling vehicle) on at least a portion of a track. For example, the WILD data capture system 202 can be in operable communication with strain gauges, cameras, LIDAR, radar, or any other device or mechanism suitable to detect movement (and/or position) on a track, and the vehicle detection module 122 can be configured to receive data from these components and determine if a vehicle is present. In another embodiment, the environmental data capture module 202 can be configured to receive and/or obtain environmental data (e.g., data related to environmental conditions). For example, the WILD data capture system 202 can be in operable connection with a weather station 108 that can collect, store, and make available data related to, weather conditions, such as temperature, precipitation, pressure, and humidity, among others. In one example, detection of a vehicle by the vehicle detection module 122 can initiate the environmental data capture module 124, such that the environmental data capture module 124 can receive environmental data corresponding to a window of time in which the vehicle is detected. In another embodiment, the weather station 108 can periodically transmit (wired or wirelessly) captured environmental data to the server 102. In another embodiment, the weather station 108 can asynchronously transmit (wired or wirelessly) environmental data to the server 102 based upon one or more thresholds stored on the weather station 108.

In another embodiment, the geopositioning module 126 can be configured to receive, obtain, generate, transmit, and/or store a location of the detected vehicle and/or the track. For example, the WILD data capture system 202 can be operably coupled with a global positioning system that can track a location of a vehicle, such that when the vehicle detection module 122 detects the vehicle, the geopositioning module 126 can receive a location of the vehicle from the global positioning system. In another embodiment, the WILD data capture system 202 can be operably coupled with sensors and other components that maintain a static location that can be transmitted amongst the system 200. For example, the vehicle detection module 122 can detect a vehicle via a coupled sensor, and upon detection, the geopositioning module 126 can receive a location from the coupled sensor. In another embodiment, the geopositioning module 126 can retrieve a plurality of stored locations corresponding to a plurality vehicles, tracks, sensors, or other components that the geopositioning module 126 can associate with detections from the vehicle detection module 122. In another embodiment, the geopositioning module 126 can transmit a location, such as a location of a detected vehicle and/or the portion of track the vehicle is traveling on, to another system (e.g., third party system).

In another embodiment, the vehicle data capture module 128 can be configured to capture vehicle-specific data. For example, the vehicle data capture module 128 can be operably coupled with, e.g., an RFID reader that can facilitate the reception of data from an RFID chip on a vehicle. In one embodiment, the RFID chip can include a date, a time, an Axle count of the vehicle, an identification of the vehicle, a direction the vehicle is traveling, and/or a load that the vehicle bears. In another embodiment, the RFID chip can include a plurality of data related to where the vehicle has been, where it is located currently, and where it is going. In another example, the vehicle data capture module 128 can be operably coupled to any other device or component suitable to capture data related to a vehicle, such as a strain gauge, camera, radar, etc. For example, the vehicle data capture module 128 can be coupled with a camera that can detect a serial number of a vehicle or other identifying information. The vehicle data capture module 128 can receive data from a sensor that can measure, for example, stress applied to a rail or a track. In another embodiment, the vehicle data capture module 128 can receive data from a strain gauge coupled to a rail of a track that can measure stress in the rail as it varies with the passing of a vehicle on the track. In another example, the vehicle data capture module 128 can receive data from any sensor or sensors that can measure a force applied to the rail, such as by a vehicle travelling over the rail. In another embodiment, the vehicle data capture module 128 can receive data related to a force applied to a rail and/or rails over a predetermined period of time.

In another embodiment, the WILD impact load detection system 200 can include a WILD calibration system 204. The WILD calibration system 204 can include a force determination module 130 and a force calibration module 132. In one embodiment, the force determination module 130 can be configured to receive data from the WILD data capture system 202 and use the data in determining a force and/or forces applied to a portion of a track and/or rail. For example, the force determination module 130 can receive data from the vehicle data capture module 128; in another example, the force determination module 130 can receive data having particular units and convert the data to reflect units of force. In one embodiment, the force determination module 130 can receive a plurality of sensor data captured by the vehicle data capture module 128 and use the sensor data to determine a max force (max peak force) (original max force) (original max peak force) applied to the rail as detected by the sensor. In one embodiment, the force determination module 130 can determine a weight of a vehicle and an impact force from the determined max force. In another embodiment, the force determination module 130 can be configured to create a plot of the sensor data and identify trends in the plot that can correspond to a number of relevant force measurements. For example, and in one embodiment, the force determination module 130 can create a plot showing the static peak force trend and max force in a graph displaying the magnitude of the measured force over time.

In one embodiment, the force determination module 130 can review the sensor data and recognize a static peak force trend (an example of which is shown above). In one embodiment, a static peak force trend can refer to a measurement (within a margin of error) with the highest instance. In another embodiment, the force determination module 130 can use the static peak force trend and/or the sensor data to determine a weight of a vehicle on a rail, such as by averaging all of the plot points located within the trend to arrive at a determined weight of the vehicle. In another embodiment, the force determination module 130 can be configured to recognize trends (e.g., a static peak force trend) in the data without plotting the data.

In another embodiment, the force determination module 130 can distinguish between a weight of a vehicle and an impact force (dynamic force), such as can be caused by imperfections or defects in a wheel, a rail, a vehicle, or other component participating in the application of force to a rail. For example, a static peak force trend can correlate with a weight of a vehicle because the majority of the wheel of the vehicle can generally be free of defects—the force exerted by a vehicle on a track via the wheel can remain largely unchanged as the unmarred portions of the wheel support the vehicle's weight. In another example, as the wheel rotates on the track and disposes a defect of the wheel between the track and the vehicle, the force exerted by the vehicle on the rail can increase, and such increase (the apex of which can be considered a max force value) from the static peak force trend can correlate with a dynamic force. In another example, the force determination module can utilize a determined weight of a vehicle and the max force of the vehicle in calculating the dynamic force. For example, in one embodiment, subtracting the vehicle weight from the max force value can yield the dynamic force value.

In another embodiment, the WILD calibration system 204 can include a force calibration module 132. The force calibration module 132 can be configured to utilize data from the force determination module 130 and WILD data capture system 202 to calibrate force values determined by the force determination module 130, such as to account to environmental conditions. For example, the force calibration module 132 can receive a max force value from the force determination module 130 and weather data from the WILD data capture system 202, and algorithmically adjust/calibrate the max force value to account for the received weather data. In one embodiment, the force calibration module 132 can calibrate a max force value to account for changes in temperature. For example, the force calibration module 132 can be configured to adjust max force values (e.g., for the purposes of alert severity level assignment, generation, and delivery) to account for increased rail tension, such as can be caused by linear shrinkage of a rail due to cold weather. In another example, the force calibration module 132 can be configured to adjust max force values to account for decreased rail tension, such as can be caused by linear expansion of a rail due to warm weather. In another embodiment, the force calibration module 132 can be configured adjust max force values determined by the force determination module 130 to compensate or account for any environmental conditions, including, but not limited to, temperature, pressure, humidity, wind speed, precipitation, UV index, and storm patterns.

In one embodiment, the force calibration module 132 can calibrate a max force value using an operational variable. For example, the force calibration module 132 can apply a mathematical equation that implements the operational variable, which can change depending on the condition being compensated for. In another embodiment, the operational variable can be a constant that can correspond to particular temperature thresholds. In another embodiment, the operational variable can be a constant corresponding to the material in the rail. In another embodiment, the operational variable can be a constant corresponding to typical linear expansion or shrinkage of a rail in certain temperatures. In one embodiment, the force calibration module 132 can utilize the following equation:

$$K_{adjusted}=(\sqrt{K_{\text{original}}}\times(1-(^\circ\,\text{F}._{deviation\ from\ temperature\ threshold}\times V)))^2$$

In one embodiment, $K_{original}$ can refer to a max force value determined by the force determination module 130. In another embodiment, $K_{original}$ can include a value in "kips," or a measurement indicating thousands of pounds (e.g., 1 kip=1000 lbs.). In another embodiment, $K_{adjusted}$ can refer to calibrated and/or adjusted max force value. In another embodiment, V can be an operational variable. In one embodiment, V can be in the range of 0.001000 to 0.0018000. In another embodiment, V can be in the range of −0.004000 to −0.005500. In another embodiment, V can be equal to −0.0048809; in another embodiment, V can be equal to 0.001604. In another embodiment, the operational variable can be derived by setting a relationship, such as a 100 kip value at 0° F. can be adjusted down to 90 kips. In one embodiment, the value of V can change depending on the temperature being compensated for (e.g., hot or cold). In another embodiment, V can also change depending on a temperature threshold. In another embodiment, a temperature threshold can vary depending on if cold or hot weather is being compensated for. For example, a temperature threshold can be designed to account for decreased rail tension due to warmer weather, and $^\circ\,\text{F}._{deviation\ from\ temperature\ threshold}$ can refer to a number of degrees above a temperature threshold (as an example, 100° F.). For example, if the temperature is 110° F., and the temperature threshold is 100° F. the integer "10" can be inserted for ° F. deviation from temperature threshold. In another embodiment, the above equation can be modified as follows to calibrate a max force value to account for temperatures below freezing (e.g., below the freezing point of water):

$$K_{adjusted}=(\sqrt{K_{\text{original}}}\times(1-(°\ F._{below\ freezing}\times V)))^2$$

In another embodiment, the force calibration module 132 can account for an amount of time an environmental condition has been present. For example, if a temperature has been above or below a temperature threshold (or otherwise satisfied a temperature threshold) for a set amount of time (e.g., two hours), the force calibration module 132 can further calibrate the max force value to account for this duration and temperature. In one embodiment, the force calibration module 132 can provide an increased calibrated max force value to account for hotter temperatures present over longer periods of time and provide a decreased calibrate max force value to account for colder temperatures present over long periods of time, as compared to the original max force value. In one embodiment, the force calibration module 132 can calibrate max force values only if a temperature falls below freezing, or if a temperature rises above 100° F.

In another embodiment, the wheel impact load detection system 200 can include an alert management system 206. The alert management system 206 can include an alert generation module 134 and an alert delivery module 136. In another embodiment, the alert generation module 134 can receive data from the WILD data capture system 202 and/or the WILD calibration system 204. For example, the alert generation module 134 can receive that a vehicle has been detected, a location of the vehicle, environmental conditions, and/or an identity of the vehicle. In another example, the alert generation module 134 can receive a max force value (and/or a calibrated max force value) and determine if the (calibrated) max force value exceeds one or more force thresholds. In another embodiment, the alert generation module 134 (and/or the force determination module 130) can determine a confidence level in the data received from one or more systems and/or sensors. In another embodiment, the alert generation module 134 can utilize received data to generate an alert with an assigned severity level. For example, an alert can be assigned a severity level (e.g., Levels 1-3) based on the (calibrated) max force value and the confidence level, a tabulated example of which is shown below:

| | Severity | | |
|---|---|---|---|
| Confidence | Least Severe | Severe | Most Severe |
| 15% - Chance | 3 | 3 | 2 |
| 50% - Possible | 3 | 3 | 1 |
| 85% - Likely | 3 | 2 | 1 |
| 97% - Near Certain | 3 | 1 | 1 |

In one embodiment, severity levels can indicate to a railroad system what action is recommended to address the alert. For example, a Level 1 alert can indicate that the vehicle should be stopped immediately and inspected. In another example, a Level 2 alert can indicate that an inspection (e.g., of the wheels and/or Axles of the vehicle) can wait until the next scheduled inspection. In another example, a Level 3 alert can indicate that an inspection can wait until the vehicle has been fully emptied of cargo and/or until its last visit to a mechanical facility prior to going offline. In another embodiment, multiple other severity levels of alerts are possible. For example, an Opportunistic alert can indicate that the vehicle (or particular parts of the vehicle, e.g., wheels) needs to be inspected only when the vehicle is receiving repairs for a different issue. In another example, a Level 4 alert can indicate that the alert generation module 134 utilized a calibrated max force (e.g., instead of an original max force) in generating the alert, such that a Level 4 alert can indicate to the railroad system that the alert severity was adjusted as a result of calibration for environmental conditions. In another embodiment, a Level 4 alert can indicate that an original max force value exceeded a force threshold, while a calibrated max force value fell below the force threshold. In another embodiment, a Level 4 alert can indicate the same recommended action as the Opportunistic alert, but can further inform a railroad system that the alert was generated by accounting for environmental conditions.

In another embodiment, the severity levels of alerts generated by the alert generation module 134 can be based at least in part on (calibrated) max force values. In one example, and with reference to the above table, a kip value of 140 or more (e.g., 140,000 lbs.) can be categorized as "Most Severe;" a kip value between 120 and 140 can be "Severe," and a kip value between 90 and 120 can be "Least Severe." In another embodiment, a kip value between 80 and 90 can generate an Opportunistic alert. Other kip values or (calibrated) max force values can be utilized in these categories instead of those discussed above. In another embodiment, the alert generation module 134 can utilize a number of force thresholds and confidence thresholds in assigning a severity level. For example, if a max force value falls below a first force threshold (e.g., 80 kips), the alert generation module 134 can determine, without considering a confidence level, to not generate an alert. In another example, if a confidence level falls below a first confidence threshold (e.g., 15%), the alert generation module 134 can determine, without considering a max force value, to not generate an alert. In another embodiment, the alert generation module 134 can utilize any number of force and/or confidence thresholds to assign a severity level for a generated alert.

In another embodiment, the alert delivery module 136 of the alert management system 206 can transmit alerts throughout a railroad system. For example, the alert delivery module 136 can receive an alert with an assigned severity level from the alert generation module 134 and communicate the alert to personnel, networked servers, or any other components in operable connection with the network or alert delivery module 136. In one embodiment, the alert delivery module 136 can transmit alerts via messages, records, or any other suitable form of communication. In another embodiment, the alert delivery module 136 can update a record with a generated alert.

Figure 3:
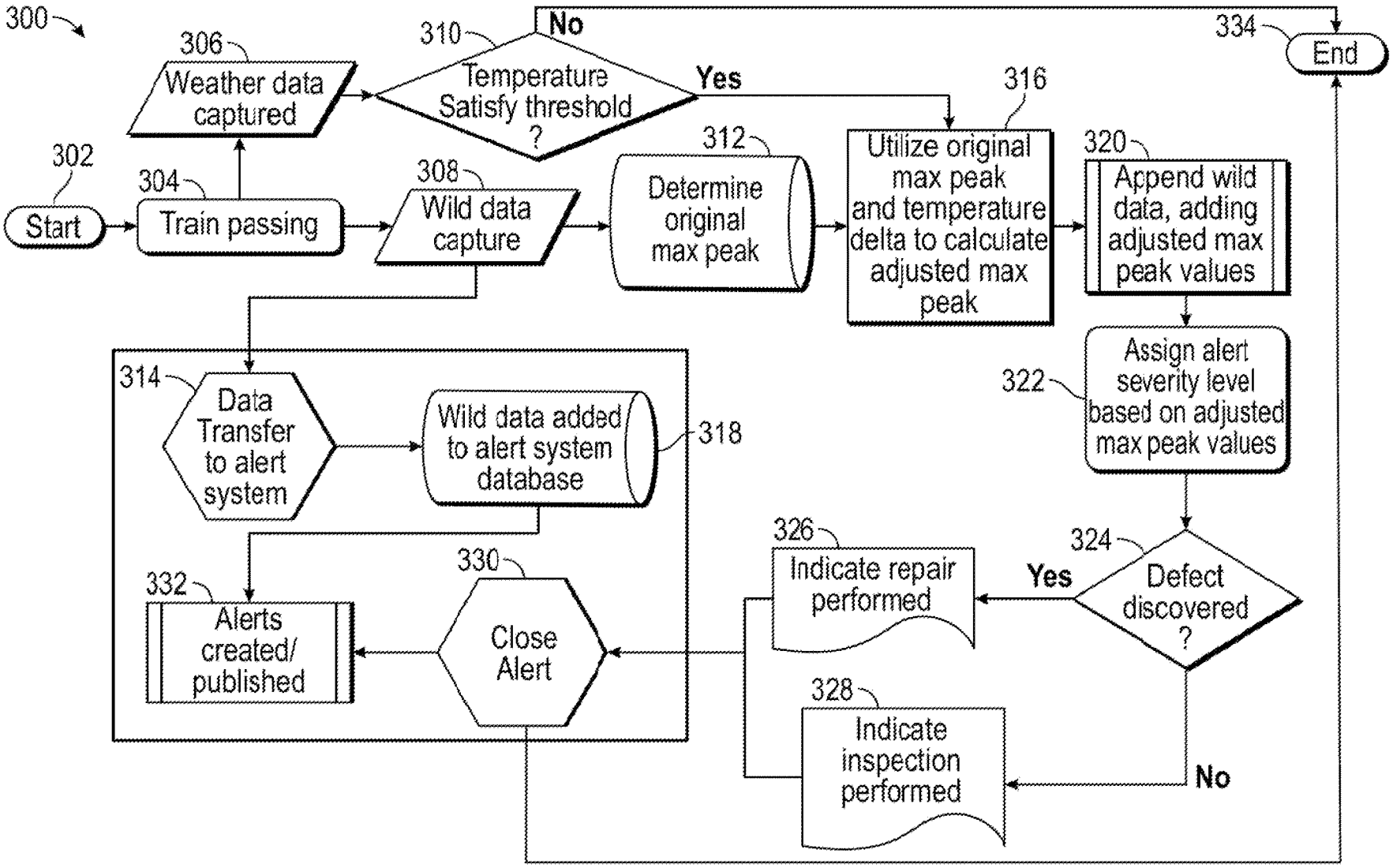
FIG. 3 illustrates a flowchart exemplifying wheel impact load detection system flow control logic, in accordance with one or more exemplary embodiments of the present disclosure.

FIG. 3 illustrates a flow chart diagram 300 exemplifying control logic embodying features of a method of wheel impact load detection (WILD), in accordance with an exemplary embodiment of the present disclosure. The WILD control logic 300 can be implemented as an algorithm on a server (e.g., server 102), a machine learning module, or other suitable system. Additionally, the WILD control logic 300 can implement or incorporate one or more features of the WILD system 200, including the wild capture system 202 (with corresponding modules 122, 124, 126, and 128), wild calibration system 204 (with corresponding modules 130 and 132), and alert management system 206 (with corresponding modules 134 and 136). The WILD control logic 300 can be achieved with software, hardware, an application programming interface (API), a network connection, a network transfer protocol, HTML, DHTML, JavaScript, Dojo, Ruby, Rails, other suitable applications, or a suitable combination thereof.

The WILD control logic 300 can leverage the ability of a computer platform to spawn multiple processes and threads by processing data simultaneously. The speed and efficiency of the WILD control logic 300 is greatly improved by instantiating more than one process to facilitate wheel impact load detection. However, one skilled in the art of programming will appreciate that use of a single processing thread may also be utilized and is within the scope of the present disclosure.

The WILD control logic 300 process flow of the present embodiment begins at step 302, wherein the control logic 300 instantiates. In one embodiment, the control logic 300 can be configured to receive data from sensors or other data-gatherers on and/or by a railroad track and instantiating the control logic 300 at step 302 can prepare the control logic 300 to receive and process the anticipated data. The control logic 300 then proceeds to step 304.

At step 304, the control logic 300 can detect a train passing along a particular portion of track. For example, the control logic 300 can receive data from a motion sensor indicating that a train is passing; in another embodiment, the control logic 300 can receive data from a strain gauge indicating that a train is exerting force on a portion of a track. In one embodiment, step 302 can be related to and/or considered to be performed by the vehicle detection module 122. The control logic 300 then proceeds to steps 306 and 308.

At step 306, the control logic 300 can capture environmental data, such as weather data. In one embodiment, step 306 can be related to and/or considered to be performed by the environmental data capture module 124. In another embodiment, step 306 can include receiving weather data from a weather station (e.g., weather station 108). In another embodiment, step 306 can include receiving one or more temperature measurements, such as ambient temperature measurements. The control logic 300 then proceeds to step 310.

At step 310, the control logic 300 can determine if a temperature threshold is satisfied. In one embodiment, a temperature threshold can be satisfied if a temperature (e.g., a temperature received at step 306) is below, above, and/or equal to a predetermined temperature or temperatures. In an exemplary embodiment, a temperature threshold is satisfied if the temperature (e.g., ambient temperature) at step 306 is below 32° F. If the temperature threshold is satisfied, the control logic 300 then proceeds to step 316. If the temperature threshold is not satisfied, the control logic 300 then proceeds to step 336.

At step 308, the control logic 300 can capture wheel impact load detection (WILD) data. In one embodiment, step 308 can be related to and/or considered to be performed by the vehicle data capture module 128 and/or the geopositioning module 126. In another embodiment, the control logic 300 can receive the identity of the train, measurements (e.g., measurement of strain and/or stress on the track), the location of the train, and other relevant data. The control logic 300 then proceeds to steps 312 and 314.

At step 314, the data captured at step 308 can be transferred and/or transmitted to an alert system (e.g., alert management system 206). For example, and in one embodiment, the control logic 300 can create a record that includes the data and transmit the record to an alert system, such as to facilitate the generation of an alert by the alert system. In another embodiment, the control logic 300 can send a message to the alert system that communicates the data. The control logic 300 then proceeds to step 318.

At step 318, the data transferred to the alert system at 314 can be stored in an alert system database, or any other database in operable connection with the control logic 300. The control logic 300 then proceeds to step 332.

At step 332, the control logic 300 can create and publish alerts using the data stored in the database at step 318. In one embodiment, step 332 can be related to and/or considered to be performed by the force determination module 130, the alert generation module 134, and/or the alert delivery module 136. For example, the control logic 300 can determine a max peak (e.g., max force, such as the max peak determined at step 312), compare the max force with predetermined force thresholds, and determine if an alert should be created and published. The control logic 300 can also assign a severity level to the alert at step 332 based at least in part on the max peak and predetermined force thresholds. In one embodiment, the alert can be published to the railroad system to notify personnel of a recommended action.

At step 312, the control logic 300 can determine an original max peak (original max peak force). In one embodiment, step 312 can be related to and/or considered to be performed by the force determination module 130. In another embodiment, the original max peak can refer to the original max force that can be determined from the data captured at step 308. For example, at step 312, the control logic 300 can determine an original kip value that can be used in assigning a severity level to an alert. The control logic 300 then proceeds to step 316.

At step 316, if the temperature threshold was satisfied in step 310, the control logic 300 can utilize the original max peak and the temperature delta (e.g., amount of deviation of the measured temperature from the temperature threshold) to calculate an adjusted max peak (calibrated max peak force). In one embodiment, step 316 can be related to and/or considered to be performed by the force calibration module 132. If the temperature threshold is not satisfied in step 310, the temperature delta can be zero, meaning that the adjusted max peak can be equal to the original max peak. The control logic 300 then proceeds to step 320.

At step 320, the control logic 300 appends the WILD data captured at step 308 with the adjusted max peak value determined at step 316. In one embodiment, step 320 can be related to and/or considered to be performed by the force calibration module 132 and/or the alert delivery module 136. The control logic 300 then proceeds to step 322.

At step 322, the control logic 300 assigns a severity level to an alert based at least in part on the adjusted max peak value. In one embodiment, step 322 can be related to and/or considered to be performed by the alert generation module 134. In one embodiment, the severity level assigned at step 322 can differ from the severity level of the alert created in step 332. For example, when WILD data is captured at step 308, the control logic 300 can assign an initial severity level that does not account for environmental conditions (e.g., the weather data captured at step 306). After consideration of the temperature threshold at step 310, the control logic can then amend the severity level at step 322. In one embodiment, the severity level assigned at step 322 can act as an "internal" alert, informing need-to-know railroad personnel of recommended actions, while the alert created and published at step 332 can remain outstanding until it is closed in accordance with the control logic 300 process flow. In another embodiment, the severity level assigned at step 322 can override the severity level assigned at step 332, such that the alert created and published at step 332 can be amended to reflect the new severity level assigned at step 322. The control logic 300 then proceeds to step 324.

At step 324, the control logic 300 can then receive input as to whether a defect (e.g., a billable defect) was discovered after the alert was acted upon. For example, once an inspection is performed in accordance with the assigned severity level, the control logic 300 can receive a command indicating that defect was found or not. If a defect is found, the control logic 300 then proceeds to step 326. If a defect is not found, the control logic then proceeds to step 328.

At step 326, the control logic 300 can receive input indicating that an inspection was performed. In one embodiment, the inspection input can be an e-mail, text, flag, message, or other suitable notification. The control logic 300 then proceeds to step 330. At step 328, the control logic 300 can receive input indicating that a repair was performed to address the defect. In one embodiment, the repair input can be an e-mail, text, flag, message, or other suitable notification. The control logic 300 then proceeds to step 330.

At step 330, the alert with the assigned severity level can be closed. For example, if it is indicated to the control logic in step 326 that a defect was repaired, the control logic 300 can moot the alert, such that the control logic 300 can close the alert. Similarly, if it is indicated to the control logic 300 at step 328 that an inspection was performed, the control logic 300 can close the alert. The control logic 300 then proceeds to step 332 and 334. At step 332, the control logic 300 publishes that the alert has been closed. At step 334, the control logic 300 can terminate or await a new train detection and can repeat the aforementioned steps.

In one embodiment, steps 304, 306, and 308 of the control logic 300 can correspond with the WILD data capture system 202. In another embodiment, steps 310, 312, 316, and 320 can correspond with the WILD calibration system 204. In another embodiment, steps 314, 318, 322, 324, 326, 328, 330, and 332 can correspond with the alert management system 206.

Figure 4:
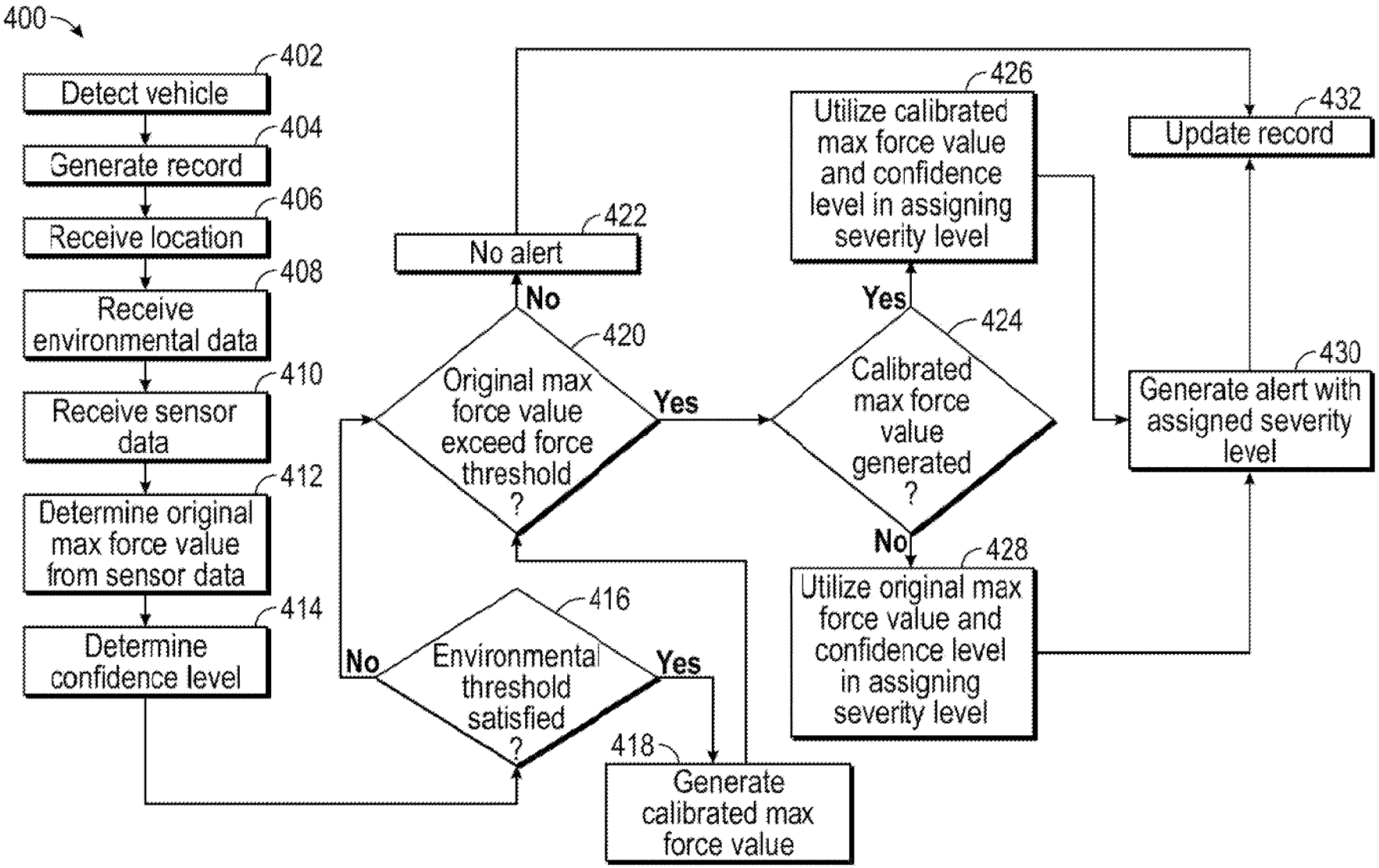
FIG. 4 illustrates a flowchart exemplifying wheel impact load detection system control logic, in accordance with one or more exemplary embodiments of the present disclosure.

FIG. 4 illustrates a flow chart diagram 400 exemplifying control logic embodying features of a method of wheel impact load detection (WILD) and calibration, in accordance with an exemplary embodiment of the present disclosure. The detection and calibration control logic 400 can be implemented as an algorithm on a server (e.g., server 102), a machine learning module, or other suitable system. Additionally, the detection and calibration control logic 400 can implement or incorporate one or more features of the WILD system 200, including the wild capture system 202 (with corresponding modules 122, 124, 126, and 128), wild calibration system 204 (with corresponding modules 130 and 132), and alert management system 206 (with corresponding modules 134 and 136). The control logic 400 can be achieved with software, hardware, an application programming interface (API), a network connection, a network transfer protocol, HTML, DHTML, JavaScript, Dojo, Ruby, Rails, other suitable applications, or a suitable combination thereof.

The control logic 400 can leverage the ability of a computer platform to spawn multiple processes and threads by processing data simultaneously. The speed and efficiency of the control logic 400 is greatly improved by instantiating more than one process to facilitate wheel impact load detection. However, one skilled in the art of programming will appreciate that use of a single processing thread may also be utilized and is within the scope of the present invention.

The control logic 400 process flow of the present embodiment begins at step 402, where the control logic 400 detects a vehicle, e.g., a vehicle traveling on a track. In one embodiment, step 402 can be related to and/or considered to be performed by the vehicle detection module 122. The control logic 400 then proceeds to step 404.

At step 404, the control logic 400 can generate a record. In one embodiment, step 404 can be related to and/or considered to be performed by the vehicle data capture module 128. In one embodiment, the record can include data related to the vehicle, such as a time and date of detection, an identify of the vehicle, an Axle count of the vehicle, and/or a direction the vehicle is traveling. The record can be stored on a client, a server, or a database. The control logic 400 then proceeds to step 406.

At step 406, the control logic 400 can receive a location, such as a location of the vehicle, a location of the track, etc. In one embodiment, step 406 can be related to and/or considered to be performed by the geopositioning module 126. For example, the control logic 400 can receive location data from a sensor on the vehicle or on the track; in another example, the control logic 400 can receive a location from a railroad system. The control logic 400 then proceeds to step 408.

At step 408, the control logic can receive environmental data. In one embodiment, step 408 can be related to and/or considered to be performed by the environmental data capture module 124. The environmental data can include humidity, pressure, temperature, or any other type of environmental data. The control logic then proceeds to step 410.

At step 410, the control logic 400 can receive data from a sensor, such as a sensor on the track or the vehicle. In one embodiment, step 410 can be related to and/or considered to be performed by the vehicle data capture module 128. Preferably, the control logic 400 receives data from a sensor that can indicate a strain/stress corresponding to a weight or mass of the vehicle. In one example, the sensor can be a strain gauge coupled to the track. The control logic 400 then proceeds to step 412.

At step 412, the control logic 400 can determine an original max force value from the sensor data. In one embodiment, step 412 can be related to and/or considered to be performed by the force determination module 130. The control logic 400 then proceeds to step 414.

At step 414, the control logic 400 can determine a confidence level. In one embodiment, step 414 can be related to and/or considered to be performed by the force determination module 130, and/or the alert generation module 134. In another embodiment, the confidence level can be a measure of confidence in an accuracy of the sensor data received at step 410. For example, and in one embodiment, data received at step 410 can be received from one or more sensors. If multiple sensors yield similar measurements, the control logic 400 can determine at step 414 that a confidence level should be higher. If, on the other hand, only one sensor yields useable measurements, the control logic 400 at step 414 can determine that a confidence level should be lower. In another embodiment, if the measurements from the sensors are not uniform, but instead more erratic, the control logic 400 can determine that the confidence level should be lower. In another embodiment, if the received data provides multiple data points that seem appropriately uniform, the control logic 400 can determine that the confidence level should be higher. In one embodiment, the control logic 400 can give a determined confidence level a percentage value (e.g., like the table discussed above with respect to the alert generation module 134). The control logic 400 can then proceed to step 416.

At step 416, the control logic 400 can determine whether an environmental threshold is satisfied. In one embodiment, step 416 can be related to and/or considered to be performed by the force calibration module 132. In one embodiment, the environmental threshold can be a pressure threshold, such that if the environmental data received at step 408 indicates a pressure that is below, equal to, or above the pressure threshold, the pressure threshold can be satisfied or not. In another embodiment, the environmental threshold can be a temperature threshold, such as the temperature threshold discussed with respect to the force calibration module 132 and the alert generation module 134 above. If the environmental threshold is satisfied, the control logic 400 proceeds to step 418. If the environmental threshold is not satisfied, the control logic 400 proceeds to step 420.

At step 418, the control logic 400 can generate a calibrated max force value. In one embodiment, step 418 can be related to and/or considered to be performed by the force calibration module 132. In another embodiment, the control logic 400 can generate a calibrated max force value by referencing the original max force value determined in step 412 and the environmental data received in step 408. In another embodiment, the calibrated max force value can be generated by adjusting the original max force value with an operational variable. The control logic 400 then proceeds to step 420.

At step 420, the control logic 400 can determine if the original max force value exceeds a force threshold. In one embodiment, step 420 can be related to and/or considered to be performed by the alert generation module 134. In another embodiment, the control logic 400 can reference a force threshold contained in memory that can act as a kill switch—for example, if the original max force value does not exceed the force threshold, the control logic 400 can determine that no alert will be generated, regardless of the remaining process flow steps. If the original max force value does not exceed the force threshold, the control logic 400 then proceeds to step 422. If the original max force value exceeds the force threshold, the control logic 400 proceeds to step 424. At step 422, the control logic 400 can determine that no alert will be generated. In one embodiment, step 422 can be related to and/or considered to be performed by the alert generation module 134. The control logic 400 then proceeds to step 432. At step 432, the control logic 400 can update a record, such as the record generated at step 404. In one embodiment, step 420 can be related to and/or considered to be performed by the alert delivery module 136.

At step 424, the control logic 400 can determine whether a calibrated max force value was generated (e.g., whether step 418 was performed). In one embodiment, step 424 can be related to and/or considered to be performed by the alert generation module 134. If the control logic 400 generates a calibrated max force value, the control logic 400 then proceeds to step 426. If the control logic 400 does not generate a calibrated max force value, the control logic 400 then proceeds to step 428. At step 426, the control logic 400 can utilize the calibrated max force value generated at step 418 and the confidence level determined at step 414 to assign a severity level to an alert. In one embodiment, step 426 can be related to and/or considered to be performed by the alert generation module 134. In another embodiment, the severity levels can be assigned in accordance with the table discussed above with the respect to the alert generation module 134. In one example, the severity level of the alert can vary with both the calibrated max force value and the confidence level. The control logic 400 then proceeds to step 430.

At step 428, the control logic 400 can utilize the original max force value determined at step 412 and the confidence level determined at step 414 to assign a severity level to an alert. In one embodiment, step 428 can be related to and/or considered to be performed by the alert generation module 134. In another embodiment, the severity levels can be assigned in accordance with the table discussed above with the respect to the alert generation module 134. In one example, the severity level of the alert can vary with both the original max force value and the confidence level. The control logic 400 then proceeds to step 430. At step 430, the control logic 400 can generate an alert with the severity level assigned in either step 426 or step 428. The control logic 400 then proceeds to step 432. At step 432, the control logic 400 can update the record generated at step 404 to reflect that an alert was generated with the severity level assigned at step 426 or step 428, or that no alert was generated. The control logic 400 then terminates or awaits a new vehicle detection and can repeat the aforementioned steps.

In one embodiment, steps 402, 404, 406, 408, and 410 of the control logic 400 can correlate with the WILD data capture system 202. In another embodiment, steps 412, 414, 416, and 418 can correlate with the WILD calibration system 204. In another embodiment, steps 420, 422, 424, 426, 428, 430, and 432 can correlate with the alert management system 206.

Figure 5A:
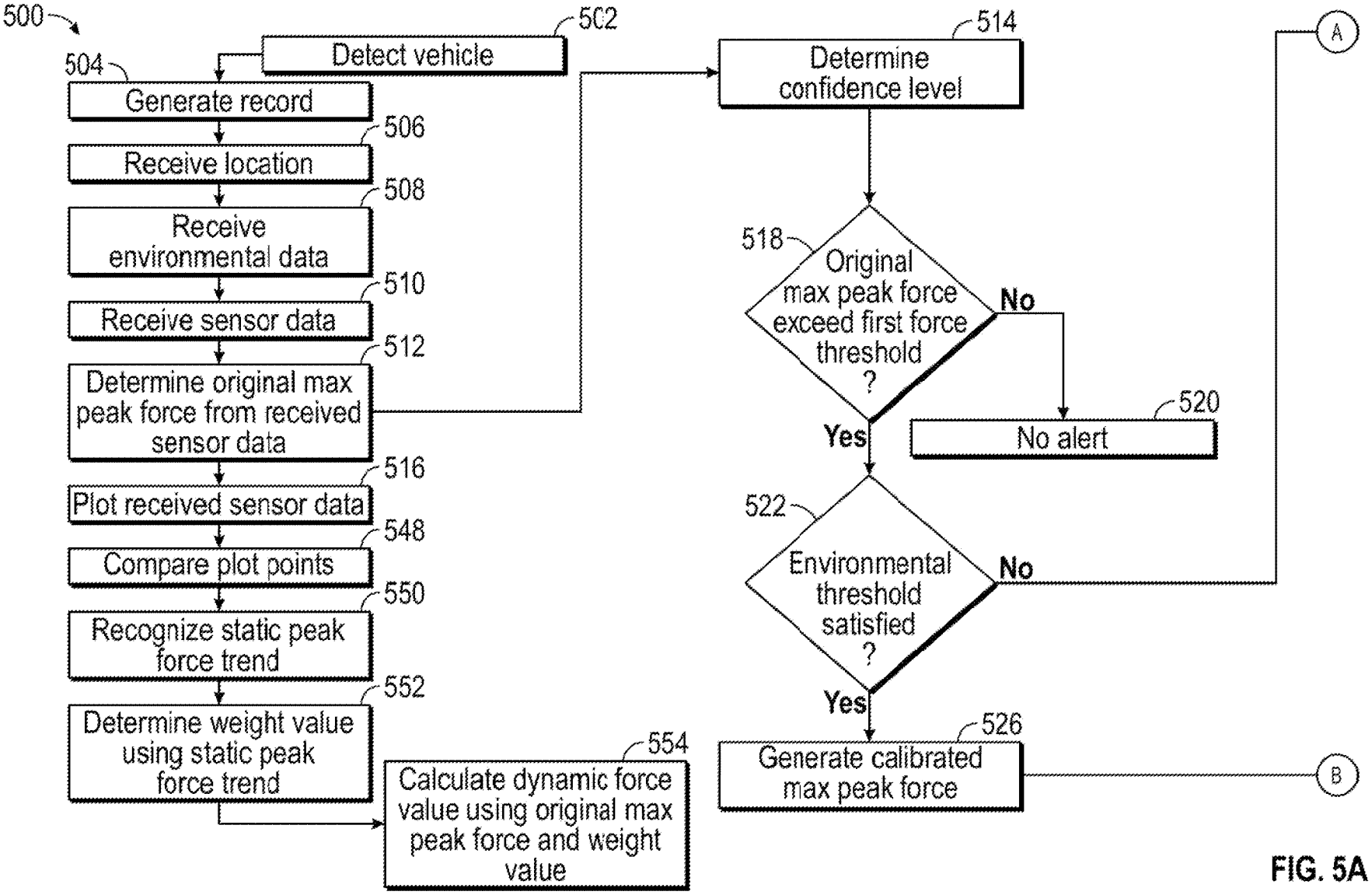
FIGS. 5A and 5B together illustrate a flowchart exemplifying wheel impact load detection system control logic, in accordance with one or more exemplary embodiments of the present disclosure.
Figure 5B:
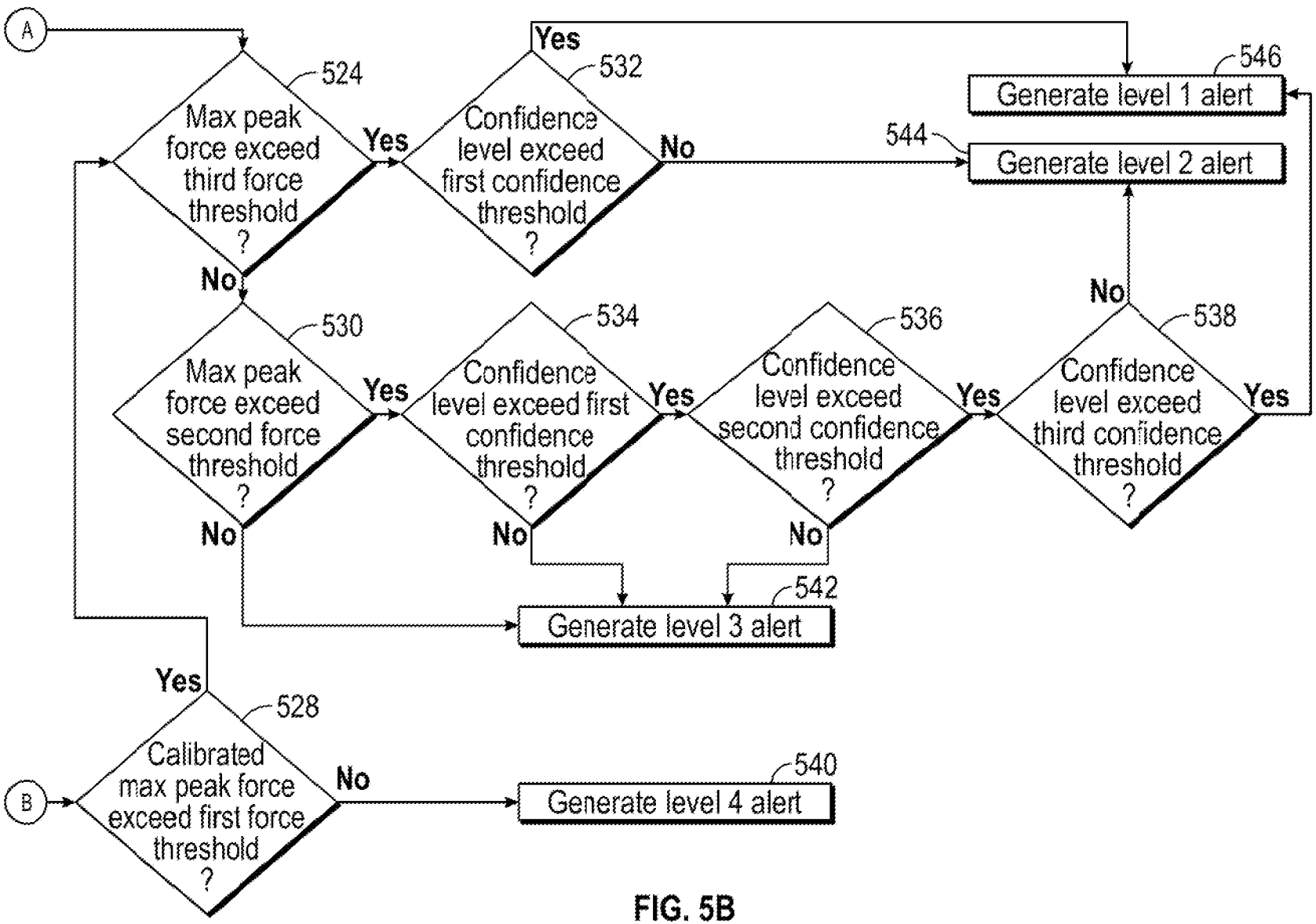

FIGS. 5A-5B illustrate a flow chart diagram 500 exemplifying control logic embodying features and program steps of a wheel impact load detection and calibration system, in accordance with an exemplary embodiment of the present disclosure. The wheel impact load detection and calibration system control logic 500 can be implemented as an algorithm on a server (e.g., server 102), a machine learning module, or other suitable system. Additionally, the wheel impact detection and calibration system control logic 500 can implement or incorporate one or more features of the WILD system 200, including the wild capture system 202 (with corresponding modules 122, 124, 126, and 128), wild calibration system 204 (with corresponding modules 130 and 132), and alert management system 206 (with corresponding modules 134 and 136). The control logic 500 can be achieved with software, hardware, an application programming interface (API), a network connection, a network transfer protocol, HTML, DHTML, JavaScript, Dojo, Ruby, Rails, other suitable applications, or a suitable combination thereof.

The control logic 500 can leverage the ability of a computer platform to spawn multiple processes and threads by processing data simultaneously. The speed and efficiency of the control logic 500 is greatly improved by instantiating more than one process to facilitate wheel impact load detection. However, one skilled in the art of programming will appreciate that use of a single processing thread may also be utilized and is within the scope of the present invention.

The control logic 500 process flow of the present embodiment begins at step 502, where the control logic 500 can detect a vehicle, e.g., a vehicle traveling on a track. The control logic 500 then proceeds to step 504. At step 504, the control logic 500 can generate a record. The control logic 500 can then proceed to step 506. At step 506, the control logic 500 can receive a location of the vehicle and/or the track. The control logic 500 then proceeds to step 508. At step 508, the control logic 500 can receive environmental data 508. The control logic 500 then proceeds to step 510. At step 510, the control logic 500 can receive data from one or more sensors; preferably, the data received relates to a force exerted by the vehicle on the track. The control logic 500 then proceeds to step 512. At step 512, the control logic 500 can determine an original max peak force from the received sensor data. In one embodiment the max peak force can correspond to the maximum force exerted by the vehicle on the track. The control logic 500 then proceeds to steps 514 and 516.

At step 514, the control logic 500 can determine a confidence level in the received sensor data in accordance with the principles of the present disclosure. The control logic 500 then proceeds to step 518. At step 518, the control logic 500 can determine if the original max peak force determined in step 512 exceeds a first force threshold. If the original max peak force does not exceed the first force threshold, the control logic 500 then proceeds to step 520. If the original max peak force exceeds the first force threshold, the control logic 500 then proceeds to step 522. At step 520, the control logic 500 can determine that no alert will be generated. At step 522, the control logic 500 can determine whether an environmental threshold is satisfied, in accordance with the principles of the present disclosure. If the environmental threshold is not satisfied, the control logic 500 then proceeds to step 524. If the environmental threshold is satisfied, the control logic 500 then proceeds to step 526.

At step 526, the control logic 500 can generate a calibrated max peak force in accordance with the principles of the present disclosure. The control logic 500 then proceeds to step 528. At step 528, the control logic 500 can determine whether the calibrated max peak force generated in step 526 exceeds the first force threshold. If the calibrated max peak force does not exceed the first force threshold, the control logic 500 then proceeds to step 540. If the calibrated max peak force exceeds the first force threshold, the control logic 500 then proceeds to step 524. At step 540, the control logic 500 can generate an alert with an assigned severity level. In one embodiment, the severity level of the alert can be a Level 4 severity level. In one embodiment, the severity level (e.g., Level 4) can signify that the original max peak force exceeded the first force threshold, and that the calibrated max peak force did not exceed the first force threshold. In another embodiment, a Level 4 alert can be of a lower severity level (and priority) than a Level 1, Level 3, and Level 3 alert. The control logic 500 then terminates or awaits a new vehicle detection and can repeat the aforementioned steps.

At step 524, the control logic 500 can determine whether a max peak force (e.g., the original max peak force or the calibrated max peak force) exceeds a third force threshold. In one embodiment, the control logic 500 can determine whether the original max peak force or the calibrated max peak force should be used at step 524 and onward. For example, the control logic 500 can determine that the calibrated max peak force should be used beginning at step 524 if a calibrated max peak force was generated at step 526. In another example, the control logic 500 can determine that the original max peak should be used beginning at step 524 if no calibrated max peak force was generated at step 526. Preferably, the third force threshold can be higher than the first force threshold. For example, the first force threshold can correspond to a lower force (e.g., a lower kip value) than the third threshold, such that if a max peak force exceeds the third force threshold, a severity level of a resulting alert can generally be higher as compared to a max peak force that does not exceed the third force threshold but does exceed the first force threshold. If the max peak force used (e.g., original or calibrated) exceeds the third force threshold, the control logic 500 then proceeds to step 532. If the max peak force used does not exceed the third force threshold, the control logic 500 then proceeds to step 530.

At step 532, the control logic 500 can determine whether the confidence level determined in step 514 exceeds a first confidence threshold. For example, a confidence threshold can take the form of a statistical probability that the received sensor data (and resulting max peak force values) are accurate. In another embodiment, a confidence threshold can be similar to that depicted in the table above, e.g., corresponding to general likelihood that the received data and determined max peak force are accurate. Preferably, the first confidence threshold can be 50%—in other words, if the confidence level determined in step 514 is less than 50%, the first confidence threshold would be considered to not be exceeded by the determined confidence level. If the confidence level exceeds the first confidence threshold, the control logic 500 then proceeds to step 546. If the confidence level does not exceed the first confidence threshold, the control logic 500 can proceed to step 544. At step 544, the control logic 500 can generate an alert with an assigned severity level. In one embodiment, the severity level can be Level 2. In another embodiment, the severity level of the alert generated at step 544 can be higher (e.g., more severe) than the severity level of the alert generated in step 540. The control logic 500 then terminates or awaits a new vehicle detection and can repeat the aforementioned steps. At step 546, the control logic 500 can generate an alert with an assigned severity level. In one embodiment, the severity level can be Level 1. In one embodiment, the severity level assigned to the alert generated in step 546 can be higher than the severity level of the alert generated in steps 544 and 540. The control logic 500 then terminates or awaits a new vehicle detection and can repeat the aforementioned steps.

At step 530, the control logic 500 can determine whether a max peak force (e.g., an original max peak force or a calibrated max peak force) exceeds a second force threshold. Preferably, the second force threshold can be between the first force threshold and the third force threshold. For example, the second force threshold can be higher than the first force threshold, and lower than the third force threshold. If a max peak force exceeds the second force threshold, the control logic 500 then proceeds to step 534. If a max peak force does not exceed the second force threshold, the control logic 500 then proceeds to step 542. At step 542, the control logic 500 can generate an alert with an assigned severity level. In one embodiment, the severity level can be Level 3. In one embodiment, the severity level of the alert generated at step 542 can be lower than the severity levels of the alerts generated at steps 544 and 546, but higher than the severity level of the alert generated in step 540. The control logic 500 then terminates or awaits a new vehicle detection and can repeat the aforementioned steps.

At step 534, the control logic 500 can determine if the confidence level determined at step 514 exceeds a first confidence threshold. In one embodiment, the first confidence threshold of step 534 can be the same as the first confidence threshold of step 532. If the first confidence threshold is exceeded, the control logic 500 then proceeds to step 536. If the first confidence level is not exceeded, the control logic 500 then proceeds to step 542. At step 536, the control logic 500 can determine if the confidence level determined at step 514 exceeds a second confidence threshold. The second confidence threshold can be similar to the first confidence threshold; preferably, the second confidence threshold can indicate a higher degree of confidence as compared to the first confidence threshold. In one embodiment, the second confidence threshold can be 85%. For example, if the confidence level determined in step 514 does not exceed 85%, the confidence level would not exceed the second confidence threshold. In another embodiment, a second confidence threshold of 85% can indicate that the control logic 500 is 85% certain that the data received from the sensors in step 510 (and resulting max peak force value) are accurate. If the confidence level exceeds the second confidence threshold, the control logic 500 then proceeds to step 538. If the confidence level does not exceed the second force threshold, the control logic 500 then proceeds to step 542.

At step 538, the control logic 500 can determine if the confidence level determined at step 514 exceeds a third confidence threshold. The third confidence threshold can be similar to the first confidence threshold and/or the second confidence threshold. Preferably, the third confidence threshold can indicate a higher degree of confidence as compared to the first confidence threshold and the second confidence threshold. In one embodiment, the third confidence threshold can be 97%. For example, if the confidence level determined in step 514 does not exceed 97%, the confidence level would not exceed the third confidence threshold. If the confidence level exceeds the third confidence threshold, the control logic 500 then proceeds to step 546. If the confidence level does not exceed the third confidence threshold, the control logic 500 then proceeds to step 544.

At step 516, the control logic 500 can plot the data from the sensor received in step 510. For example, the control logic 500 can create a plot like the one discussed above with respect to the force determination module 130. Preferably, the plot can include a force axis and a time axis, such that points on the plot can be coordinated by magnitude of force and the time at which the force was exerted. In another embodiment, the data received in step 510 can be data from one or more strain gauges, and the control logic 500 can convert the units of measurement provided by the strain gauge (e.g., με, in./in., mm/mm, etc.) into a force measurement and/or a mass measurement, such as Newtons, pounds, kilograms, etc., and subsequently plot the force measurements according to the time at which the data was received. The control logic 500 then proceeds to step 548. At step 548, the control logic 500 can compare the points from the plot. Preferably, the control logic 500 can search for similarities in the points and trends in the data. In one example, the control logic 500 can determine a force value (within a margin of error) having the highest instance on the plot. In one embodiment, the control logic 500 can recognize that a particular force measurement (e.g., 75 kips±5 kips) occurred most often. In another embodiment, the control logic 500 can recognize spikes in the plotted data, as well determine a maximum force measurement received by the sensor in step 510. The control logic 500 then proceeds to step 550.

At step 550, the control logic 500 can recognize a static peak force trend in the data. In one embodiment, the static peak force trend can refer to a number of measurements that can correlate with one another, such as by being close in value with one another; in another embodiment, the static peak force trend can refer to a force value range having the highest instance. In another embodiment, the static peak force trend can refer to the force measurements that are within a predetermined deviation from one another. As an example, the control logic 500 can receive ten different force measurements, occurring at ten different times, in step 510. In this example, seven of those measurements can be between 63 and 65 kips; the other three measurements can be 90 kips, 120 kips, and 100 kips, respectively. In this example, the control logic 500 can recognize that seven of the measurements correlate to one another by nature of the fact that they all fall within a range spanning only three kips—in this manner, the control logic 500 can recognize a static peak force trend in the data. In this example, the control logic 500 can further recognize that the maximum force value measure was 120 kips. The control logic 500 then proceeds to step 552. At step 552, the control logic 500 can determine a weight value of the vehicle by using the static peak force trend. In one embodiment, the control logic 500 can average all of the force values within the static peak for trend to determine a weight of a vehicle. The control logic 500 then proceeds to step 554. At step 554, the control logic 500 can calculate a dynamic force value using the original max peak force determined in step 512 and the weight value determined in step 552. In one embodiment, the control logic 500 can thereby determine the proportion of the max peak force that was due to the defect as opposed to the weight of the vehicle.

In operation, in one exemplary embodiment, the control logic 500 can begin at step 502, where a train can be detected on a track. For example, the train can be detected via at least one strain gauge coupled to the track that the train travels over; in another example, the train can be detected by LIDAR, such that the control logic 500 can prepare to receive data. The train can include identifying information that can be received by the control logic 500. For example, the train can have an RFID tag that can be read by an RFID reader in operable connection with the control logic 500. In another embodiment, the RFID tag can include the date and time that the RFID tag is read by the reader, the Axle count of the train, and the direction the train is traveling on the vehicle. In another embodiment, the date and time that the RFID tag is read can be generated by the control logic 500. The control logic 500 then proceeds to step 504. At step 504, the control logic 500 can generate a record 504 that can include the data gleaned from reading the train's RFID tag. The control logic 500 then proceeds to step 506. At step 506, the control logic 500 can receive a location of the vehicle, track, and/or spot of detection, such as from coordinates that are programmed into the sensors (RFID reader, strain gauge, etc.), from a GPS beacon on the train, or from the RFID tag. The control logic 500 then proceeds to step 508. At step 508, the control logic 500 can receive environmental data, such as a temperature (e.g., an ambient temperature) at that portion of the track where the train has been detected. In this example, the temperature received at step 508 can be 0° F. The control logic 500 then proceeds to step 510.

At step 510, in this example, the control logic 500 can receive data from a plurality of strain gauges coupled to the track. The control logic 500 then proceeds to step 512. At step 512, the control logic 500 can use the strain gauge data to determine an original max peak force—in this embodiment, the control logic 500 can determine that the original max peak force can be 140 kips. The control logic then proceeds to steps 514 and 516.

At step 516, the control logic 500 can determine a confidence level. The control logic 500 can incorporate a number of factors in determining the confidence level, such as the number of data points received in step 510 (which can, in one embodiment, signify the number of wheel revolutions that occurred in the given time and distance), the range of the measurements, the environmental data, etc. In this embodiment, the control logic 500 can determine the confidence level to be 75%. The control logic 500 then proceeds to step 518.

At step 518, the control logic 500 determines if the original max peak force exceeds the first force threshold. In this example, the first force threshold can be 90 kips, meaning that in this example, the control logic 500 then proceeds to step 522 instead of step 520 (e.g., because 140 kips exceeds 90 kips). At step 522, the control logic 500 can determine if an environmental threshold is satisfied. In this example, the environmental threshold can be a temperature threshold of 32° F., and the temperature threshold can be satisfied if a temperature received at step 508 is below 32° F. In this example, the control logic 500 can determine that the temperature received at step 508 (0° F.) satisfies the environmental threshold at step 522, and the control logic 500 then proceeds to step 526. At step 526, the control logic 500 can generate a calibrated max peak force—in this example, the control logic 500 can generate the calibrated max peak force with the following equation:

$$K_{adjusted}=(\sqrt{K_{\text{original}}}\times(1-(°\text{ F.}_{below\ freezing}\times V)))^2$$

wherein V=0.001604 and $K_{original}$=140 kips. The control logic 500 can determine, in this example, that the $K_{adjusted}$ value (which can be the calibrated max peak force) can be equal to 126 kips. The control logic 500 then proceeds to step 528.

At step 528, the control logic 500 can determine if the calibrated max peak force (126 kips) exceeds the first force threshold (90 kips). Because this is true, the control logic 500 then proceeds to step 524. At step 524, the control logic 500 can determine if the calibrated max peak force exceeds a third force threshold, which, in this example, can be 140 kips. In this example, the control logic 500 can determine that the calibrated max peak value should be used as opposed to the original max peak value. Because 126 kips is less than 140 kips, the control logic 500 then proceeds to step 530. At step 530, the control logic 500 can determine if the calibrated max peak force exceeds the second force threshold, which in this example, can be 120 kips. Because 126 kips exceeds 120 kips, the control logic 500 then proceeds to step 534.

At step 534, the control logic 500 can determine if the first confidence threshold is exceeded; in this example, the first confidence threshold can be 50%. Because the confidence level determined at step 514 in this example was 75%, the control logic 500 then proceeds to step 536. At step 536, the control logic 500 can determine if the second confidence threshold is exceeded; in this example, the second confidence threshold can be 85%. Because the control logic 500 determined the confidence level to be 75% in this example, the control logic 500 then proceeds to step 542. At step 542, the control logic 500 can generate an alert with an assigned Level 3 severity level. The control logic 500 then terminates or awaits a new vehicle detection and can repeat the aforementioned steps.

Advantageously, the force thresholds and confidence thresholds discussed herein can be of any suitable value, depending on the desired alert severity level assignments. For example, lowering the force thresholds can, in one embodiment, cause alerts with higher severity levels to be generated for vehicles applying less force to a track. In another example, decreasing confidence thresholds can also cause alerts with higher severity levels to be generated from received data with determinedly lower fidelity. In contrast, raising force thresholds and/or confidence thresholds can cause the control logic 500 to assign lower severity levels for higher impact forces determined from less accurate data.

Figure 6:
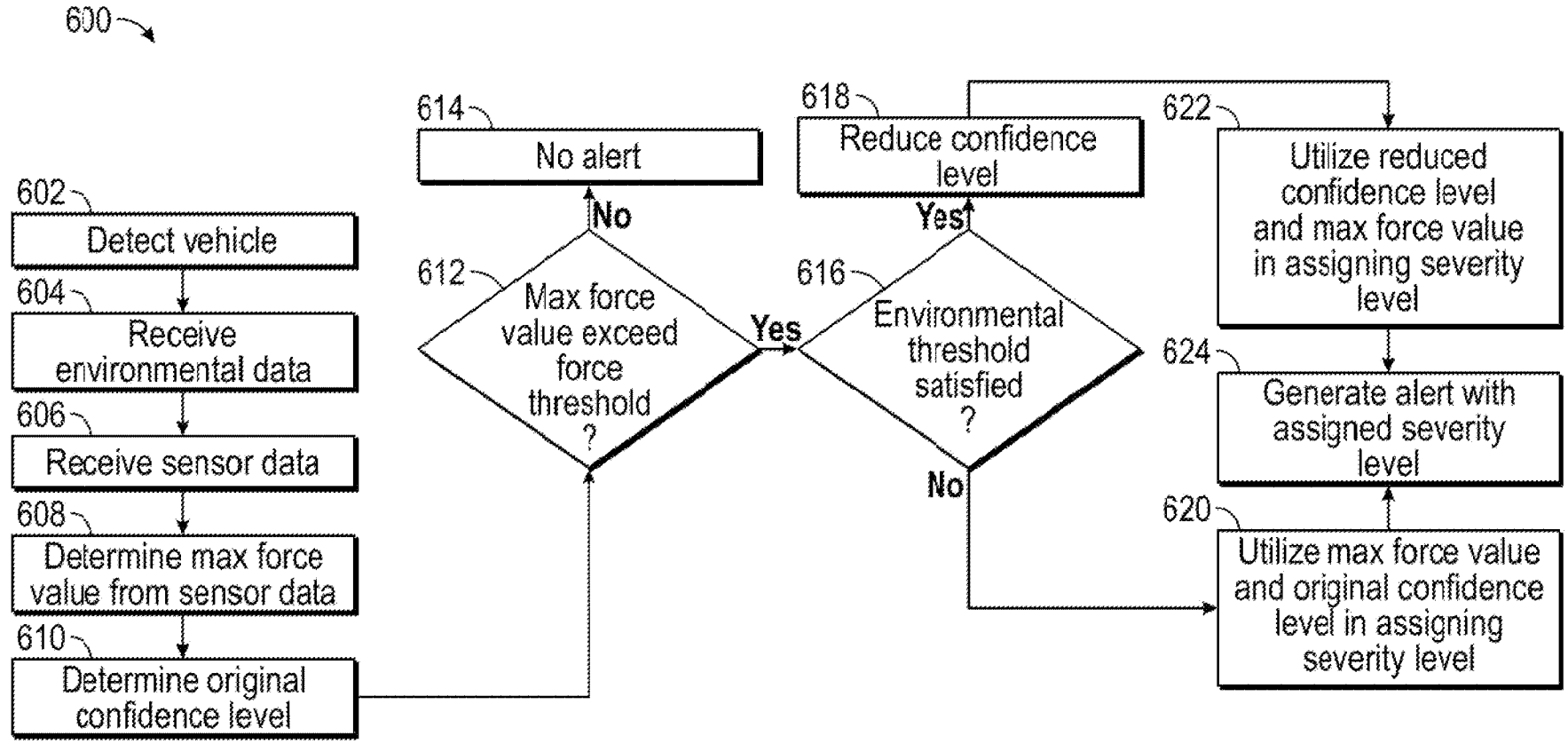
FIG. 6 illustrates a flowchart exemplifying wheel impact load detection system control logic in accordance with one or more exemplary embodiments of the present disclosure.

FIG. 6 illustrates a flow chart diagram 600 exemplifying control logic embodying features and program steps of a wheel impact load detection (WILD) system, in accordance with an exemplary embodiment of the present disclosure. The WILD system control logic 600 can be implemented as an algorithm on a server (e.g., server 102), a machine learning module, or other suitable system. Additionally, the WILD system control logic 500 can implement or incorporate one or more features of the WILD system 200, including the wild capture system 202 (with corresponding modules 122, 124, 126, and 128), wild calibration system 204 (with corresponding modules 130 and 132), and alert management system 206 (with corresponding modules 134 and 136). The control logic 600 can be achieved with software, hardware, an application programming interface (API), a network connection, a network transfer protocol, HTML, DHTML, JavaScript, Dojo, Ruby, Rails, other suitable applications, or a suitable combination thereof.

The control logic 600 can leverage the ability of a computer platform to spawn multiple processes and threads by processing data simultaneously. The speed and efficiency of the control logic 600 is greatly improved by instantiating more than one process to facilitate wheel impact load detection. However, one skilled in the art of programming will appreciate that use of a single processing thread may also be utilized and is within the scope of the present invention.

The control logic 600 process flow of the present embodiment begins at step 602, where the control logic 600 can detect a vehicle, e.g., a vehicle traveling on a track. In one embodiment, a vehicle can be detected by measuring values that exceed a rest state or threshold from one or more strain gauges operably coupled to a train track. The control logic 600 then proceeds to step 604. At step 604, the control logic 600 can receive environmental data in accordance with the principles of the present disclosure. The control logic 600 then proceeds to step 606. At step 606, the control logic 600 can receive sensor data in accordance with the principles of the present disclosure. The control logic 600 then proceeds to step 608. At step 608, the control logic 600 can determine a max force value from the sensor data receive at step 606, in accordance with the principles of the present disclosure. The control logic 600 then proceeds to step 610. At step 610, the control logic 600 can determine an original confidence level in accordance with the principles of the present disclosure. The control log then proceeds to step 612.

At step 612, the control logic 600 can determine if the max force value determined at step 608 exceeds a first force threshold. If the max force value exceeds the first force threshold, the control logic 600 then proceeds to step 616. If the max force value does not exceed the first force threshold, the control logic 600 then proceeds to step 614. At step 614, the control logic 600 can determine that no alert will be generated. At step 616, the control logic 600 can determine if the environmental data received at step 604 satisfies an environmental threshold. If the environmental data satisfies the environmental threshold, the control logic 600 then proceeds to step 618. If the environmental data does not satisfy the environmental threshold, the control logic 600 then proceeds to step 620.

At step 618, the control logic 600 can reduce the original confidence level. In one embodiment, the confidence level can be reduced commensurate with the deviation of the environmental data from the environmental threshold. For example, if the environmental threshold is a temperature threshold of 32° F., and the received environmental data indicates a temperature of 0° F., the confidence level can be reduced further than if the receive environmental data indicated a temperature of, e.g., 30° F. In another embodiment, the control logic 600 can utilize a similar equation as discussed above with respect to the force determination module 130 to adjust the confidence level as opposed to the max force value. In another embodiment, the control logic 600 can reduce the confidence level such that the confidence level falls below a confidence threshold. For example, if a first confidence threshold is 50%, a second confidence threshold is 85%, and the original confidence level is determined at step 610 to be 75%, the control logic 600 can reduce the confidence level to 49%, such that the first confidence threshold is not exceeded. The control logic 600 then proceeds to step 622.

At step 622, the control logic 600 can utilize the reduced confidence level determined at step 618 and the max force value determined at step 608 to assign a severity level in accordance with the principles of the present disclosure. The control logic 600 then proceeds to step 624. At step 624, the control logic 600 can generate an alert with the severity level assigned at step 622, in accordance with the principles of the present disclosure. At step 620, the control logic 600 can utilize the original confidence value determined at step 610 and the max force value determined at step 608 to assign a severity level in accordance with the principles of the present disclosure. The control logic 600 then proceeds to step 624.

Figure 7:
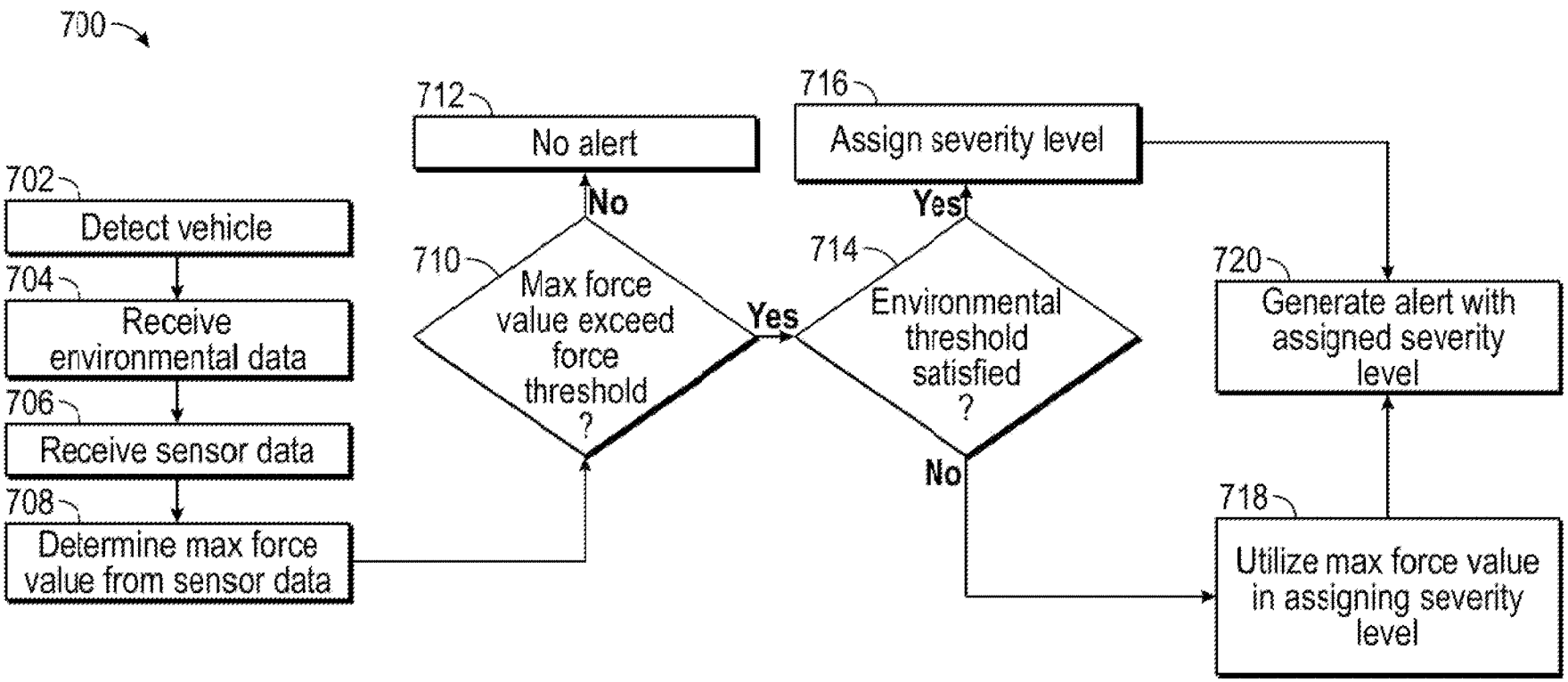
FIG. 7 illustrates a flowchart exemplifying wheel impact load detection system control logic in accordance with one or more exemplary embodiments of the present disclosure.

FIG. 7 illustrates a flow chart diagram 700 exemplifying control logic embodying features and program steps of a wheel impact load detection (WILD) method, in accordance with an exemplary embodiment of the present disclosure. The WILD method control logic 700 can be implemented as an algorithm on a server (e.g., server 102), a machine learning module, or other suitable system. Additionally, the WILD method control logic 700 can implement or incorporate one or more features of the WILD system 200, including the wild capture system 202 (with corresponding modules 122, 124, 126, and 128), wild calibration system 204 (with corresponding modules 130 and 132), and alert management system 206 (with corresponding modules 134 and 136). The control logic 700 can be achieved with software, hardware, an application programming interface (API), a network connection, a network transfer protocol, HTML, DHTML, JavaScript, Dojo, Ruby, Rails, other suitable applications, or a suitable combination thereof.

The control logic 700 can leverage the ability of a computer platform to spawn multiple processes and threads by processing data simultaneously. The speed and efficiency of the control logic 700 is greatly improved by instantiating more than one process to facilitate wheel impact load detection. However, one skilled in the art of programming will appreciate that use of a single processing thread may also be utilized and is within the scope of the present invention.

The control logic 700 process flow of the present embodiment begins at step 702, where the control logic 700 can detect a vehicle, e.g., a vehicle traveling on a track. The control logic 700 then proceeds to step 704. At step 704, the control logic 700 can receive environmental data in accordance with the principles of the present disclosure. The control logic 700 then proceeds to step 706. At step 706, the control logic 700 can receive sensor data in accordance with the principles of the present disclosure. The control logic 700 then proceeds to step 708. At step 708, the control logic 700 can determine a max force value from the sensor data receive at step 706, in accordance with the principles of the present disclosure. The control logic 700 then proceeds to step 710.

At step 710, the control logic 700 can determine if the max force value determined at step 708 exceeds a force threshold, in accordance with the principles of the present disclosure. If the max force value exceeds the force threshold, the control logic 700 then proceeds to step 714. If the max force value does not exceed the force threshold, the control logic 700 then proceeds to step 712. At step 712, the control logic 700 can determine that no alert will be generated.

At step 714, the control can determine if the environmental data received at step 704 satisfies an environmental threshold. If the environmental data satisfies the environmental threshold, the control logic 700 then proceeds to step 716. If the environmental data does not satisfy the environmental threshold, the control logic 700 then proceeds to step 718. At step 716, the control logic 700 can assign a severity level. In one embodiment, the control logic 700 can assign a severity level without reference to a max force value. In another embodiment, the control logic 700 can assign a severity level that indicates that the environmental threshold was satisfied. For example, if the environment threshold is satisfied at step 714, the control logic 700 can assign the same severity level to all potential alerts, regardless of the max force value. At step 718, the control logic 700 can utilize the max force value determined at step 708 in assigning a severity level, in accordance with the principles of the present disclosure. The control logic 700 then proceeds to step 720. At step 720, the control logic 700 generates an alert with the severity level assigned instep 716 or step 718, in accordance with the principles of the present disclosure.

It will be understood by those having skill in the art that the systems and methods disclosed herein can implement numerous force thresholds, confidence thresholds, and environmental thresholds within the same process flow to tailor the alert generation and severity level assignments to fit specific needs. In one embodiment, environmental thresholds of different types can be used in the same flow—for example, a process flow can include a temperature threshold, a pressure threshold, a humidity threshold, and/or any other type of environmental threshold related to environmental conditions that can affect wheel impact load detection. In another embodiment, a factor of time can be included the environmental thresholds, or instead be thresholds themselves. For example, an environmental threshold can require that a specific temperature be exceeded for a specific period of time before the threshold can be satisfied; in another example, an environmental threshold can require a temperature to be constantly below a specific temperature for a specific period of time before the threshold can be satisfied. In another embodiment, the systems and methods disclosed herein can incorporate time thresholds that can affect the assignment of severity levels. For example, if an environmental threshold is satisfied for a duration of time, an assigned severity level can be lower than if the environmental threshold was satisfied for a comparatively longer duration. In another embodiment, environmental data and an environmental threshold can refer to the environment of a rail. For example, environmental data can include the temperature of a rail, and an environmental threshold can include a temperature threshold related to the temperature of the rail.

The present disclosure achieves at least the following advantages:

1. Optimizing severity level assignment in wheel impact load detection alerts to account for environmental conditions;

2. Prioritizing wheel impact load detection alerts to account for environmental conditions;

3. Calibrating measured max force values applied to a rail to adjust for extreme temperatures; and 4. Providing a method to rank alerts that considers environmental conditions;

Persons skilled in the art will readily understand that these advantages (as well as the advantages indicated in the summary) and objectives of this system would not be possible without the particular combination of computer hardware and other structural components and mechanisms assembled in this inventive system and described herein. It will be further understood that a variety of programming tools, known to persons skilled in the art, are available for implementing the control of the features and operations described in the foregoing material. Moreover, the particular choice of programming tool(s) may be governed by the specific objectives and constraints placed on the implementation plan selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f).

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A system for generating railroad alerts related to wheel impact load detection sensor data, comprising:

a memory having a first database with a plurality of sensor data, thresholds, and specifications related to a vehicle and at least a portion of a track; and a networked computer processor operably coupled to the memory and capable of executing machine-readable instructions to perform program steps, the program steps including:

detecting the vehicle on the track;

receiving environmental data;

receiving sensor data corresponding to a force or forces exerted by the vehicle on the track;

determining an original max peak force from the sensor data;

comparing the original max peak force with a first force threshold;

if the original max peak force exceeds the first force threshold:

determining if the environmental data satisfies an environmental threshold; and if the environmental data satisfies the environmental threshold, generating, via the processor, a calibrated max peak force;

utilizing either the original max peak force or the calibrated max peak force in assigning a severity level;

generating an alert including the severity level; and if the original max peak force is below the first force threshold, no alert is generated.

2. The system of claim 1, wherein the calibrated max peak force is generated by normalizing the original max peak force using an operational variable.

3. The system of claim 1, wherein the program steps further include:

generating a plot of the sensor data;

comparing a plurality of points on the plot that correspond with the sensor data;

recognizing a static peak force trend in the plot;

determining a weight value using the static peak force trend; and calculating a dynamic force value using the original max peak force and the weight value.

4. The system of claim 1, wherein the program steps further include determining a confidence level of the sensor data accuracy.

5. The system of claim 4, wherein the program steps further include utilizing the confidence level in assigning the severity level.

6. The system of claim 4, wherein the severity level can vary based on a magnitude of the original max peak force or the calibrated max peak force, and the confidence level.

7. The system of claim 1, wherein if the original max peak force exceeds the first force threshold and the calibrated max peak force is below the first force threshold, the severity level indicates that the calibrated max peak force was utilized in assigning the severity level.

8. The system of claim 1, wherein the vehicle is a train.

9. The system of claim 1, wherein:

if the environmental data does not satisfy the environmental threshold, the original max peak force is utilized in assigning the severity level; and if the environmental data satisfies the environmental threshold, the calibrated max peak force is utilized in assigning the severity level.

10. The system of claim 1, wherein the environmental data includes weather data.

11. A method of compensating for environmental conditions in wheel impact load detection, the method comprising the steps of:

detecting a vehicle on a track;

generating, via one or more processors, at least one record including a date, a time, a direction of the vehicle, and an Axle count of the vehicle;

receiving environmental data;

receiving sensor data from at least one strain gauge coupled to the track;

determining an original max force value from the sensor data;

comparing the original max force value with a first force threshold;

if the environmental data satisfies an environmental threshold, generating, via the one or more processers, a calibrated max force value by calibrating the original max force value with an operational variable;

if the original max force value exceeds the first force threshold, and if the calibrated max force value was not generated, utilizing the original max force value to assign a first severity level;

if the original max force value exceeds the first force threshold, and if the calibrated max force value was generated, utilizing the calibrated max force value to assign a second severity level;

generating an alert including either the first or second severity level; and updating the at least one record;

wherein if the original max force value is below the first force threshold, the at least one record is updated without generating an alert.

12. The method of claim 11, wherein the environmental data includes temperature, and the environmental threshold is a temperature threshold.

13. The method of claim 11, further including the step of determining a confidence level in an accuracy of the sensor data.

14. The method of claim 13, wherein the confidence level is utilized with the original max force value to assign the first severity level.

15. The method of claim 13, wherein the confidence level is utilized with the calibrated max force value to assign the second severity level.

16. A method of compensating for variable rail tension caused by environmental conditions in wheel impact load detection, the method comprising the steps of:

detecting a vehicle on a track;

receiving environmental data;

receiving sensor data from at least one strain gauge coupled to the track;

determining, via one or more processors, a max force value from the sensor data;

if the max force value exceeds a first force threshold, determining if the environmental data satisfies an environmental threshold;

if the max force value exceeds the first force threshold, and if the environmental data satisfies the environmental threshold, assigning a first severity level; and if the max force value exceeds the first force threshold, and if the environmental data does not satisfy the environmental threshold, assigning a second severity level; and generating an alert including the first or second severity level;

wherein if the max force value is below the first force threshold, no alert is generated.

17. The method claim 16, further including the step of utilizing a confidence level in assigning the first or second severity level.

18. The method of claim 17, wherein if the environmental threshold is satisfied, the confidence level is reduced.

19. The method of claim 16, wherein the environmental threshold is satisfied when a temperature is equal to or below 0° C.

20. The method of claim 16, further including the step of updating a record to indicate that the alert includes the first or second severity level.

* * * * *